US008938934B2

(12) United States Patent
Brunson et al.

(10) Patent No.: US 8,938,934 B2
(45) Date of Patent: Jan. 27, 2015

(54) CORNER POST APPLICATION SYSTEM

(75) Inventors: Bruce W. Brunson, Spring Lake, MI (US); Jason A. Brake, Kent City, MI (US); Peter C. Martin, Hudsonville, MI (US); Jonathan Vansweden, Greenville, MI (US); Thomas E. Wagner, Grand Rapids, MI (US); Mark J. Clark, Grand Rapids, MI (US); Shirley Clark, legal representative, Grand Rapids, MI (US)

(73) Assignee: Mollers North America, Inc., Grand Rapids, MI (US)

( * ) Notice: Subject to any disclaimer, the term of this patent is extended or adjusted under 35 U.S.C. 154(b) by 797 days.

(21) Appl. No.: 13/219,175

(22) Filed: Aug. 26, 2011

(65) Prior Publication Data

US 2012/0055123 A1 Mar. 8, 2012

Related U.S. Application Data

(60) Provisional application No. 61/377,189, filed on Aug. 26, 2010.

(51) Int. Cl.

| | |
|---|---|
| ***B65B 61/00*** | (2006.01) |
| ***B65B 13/18*** | (2006.01) |
| ***B65B 9/13*** | (2006.01) |

(52) U.S. Cl.

CPC ..... *B65B 13/181* (2013.01); *B65B 9/135* (2013.01)

USPC ..... 53/139.7

(58) Field of Classification Search

USPC ..... 53/139.7, 410, 399, 587

See application file for complete search history.

(56) References Cited

U.S. PATENT DOCUMENTS

| | | | |
|---|---|---|---|
| 3,585,780 | A | 6/1971 | Elmore |
| 3,902,303 | A | 9/1975 | King |
| 4,897,980 | A | 2/1990 | Geyser et al. |
| 5,226,280 | A | 7/1993 | Scherer et al. |

(Continued)

FOREIGN PATENT DOCUMENTS

| | | | |
|---|---|---|---|
| CA | 2 747 134 | A1 | 3/2003 |
| EP | 0798214 | B1 | 10/2002 |
| EP | 1419966 | A1 | 5/2004 |

OTHER PUBLICATIONS

Mollers North America, Inc. brochure on PLS Split-Plate Palletizing System showing system that was in existence prior to 2010.

(Continued)

*Primary Examiner* — Robert Long

(74) *Attorney, Agent, or Firm* — Gardner, Linn, Burkhart & Flory, LLP

(57) ABSTRACT

A corner post application system comprises a conveyor subsystem and an enveloping machine adapted to envelope the plurality of units with a material. The system further includes a swing arm, an applicator arm coupled to the swing arm and adapted to move linearly, a corner post gripper coupled to the applicator arm, and a controller. The controller rotates the swing arm about a vertical axis until a corner post held by the corner post gripper is aligned with adjacent sides that define a corner of the load. The controller thereafter stops rotation of the swing arm and moves the applicator arm linearly toward the corner of the load until the corner post held by the corner post gripper contacts the adjacent sides of the load. A sensor may be included for detecting a corner of the load, with the controller aligning the corner post based on detection by the sensor.

17 Claims, 24 Drawing Sheets

(56) References Cited

U.S. PATENT DOCUMENTS

| | | | |
|---|---|---|---|
| 5,423,118 | A | 6/1995 | Lotti |
| 5,535,572 | A | 7/1996 | Morantz et al. |
| 5,544,472 | A | 8/1996 | Koskinen et al. |
| 5,546,730 | A | 8/1996 | Newell et al. |
| 5,564,254 | A | 10/1996 | Thimon et al. |
| 5,596,863 | A | 1/1997 | Kasel |
| 5,758,470 | A | 6/1998 | Lancaster, III |
| 5,868,549 | A | 2/1999 | Lee et al. |
| 6,012,266 | A | 1/2000 | Koskinen et al. |
| 6,178,721 | B1 | 1/2001 | Turfan |
| 6,883,293 | B2 | 4/2005 | Lancaster, III et al. |
| 6,990,784 | B2 | 1/2006 | Lancaster, III et al. |
| 7,213,381 | B2 | 5/2007 | Zitella et al. |
| 7,234,289 | B2 | 6/2007 | Hannen et al. |
| 7,320,172 | B1 | 1/2008 | Kamiya |
| 7,320,403 | B2 | 1/2008 | May, Jr. |
| 7,325,371 | B2 | 2/2008 | Cere' |
| 7,748,198 | B2 * | 7/2010 | Cere' ..... 53/139.7 |
| 2005/0137072 | A1 | 6/2005 | Jackson |

OTHER PUBLICATIONS

Mollers North America, Inc. brochure on PFS Floor-Level Modular Palletizing System showing system that was in existence prior to 2010.

Mollers North America, Inc. brochure on Robotic Palletizing System showing system that was in existence prior to 2010.

Mollers North America, Inc. brochure on HSA Automatic Stretch-Hooding Systems showing system that was in existence prior to 2010.

International Search Report completed Feb. 29, 2012, from corresponding International Application No. PCT/US2011/049416.

International filing date Aug. 26, 2011 Written Opinion of the International Searching Authority for International Application No. PCT/US2011/049416.

Extended European Search Report completed Feb. 4, 2014, from corresponding European Application No. EP 11 82 0748.

* cited by examiner

CORNER POST APPLICATION SYSTEM

CROSS REFERENCE TO RELATED APPLICATION

The present application claims priority of U.S. provisional application, Ser. No. 61/377,189 filed Aug. 26, 2010, by Bruce W. Brunson et al, for CORNER POST APPLICATION SYSTEM, which is hereby incorporated herein by reference in its entirety.

BACKGROUND OF THE INVENTION

The present invention relates to a system and method for automatically positioning corner posts or boards on loads, and more particularly to a system and method for automatically positioning corner posts or boards on loads that are in the process of undergoing any of a stretch-wrapping, binding, stretch-hooding, or other similar enveloping type processes.

In the past, the automatic placement of corner posts on loads—such as palletized loads of boxes, cartons, or the like—has been accomplished during stretch wrapping operations. In such systems, an applicator mechanism positions corner posts on the four corners of the load and holds them in position until the stretch wrapping operation has secured the corner posts to the load. The applicator mechanism then retracts and the wrapped load is moved via one or more conveyors. A new unwrapped load may then be moved into position for wrapping and corner posts may be placed on the load in the same manner.

Prior methods and systems for the automatic placement of corner posts have suffered from disadvantages.

SUMMARY OF THE INVENTION

The present invention provides systems and methods for automatically placing corner posts on loads during an enveloping process—such as, but not limited to, a stretch hooding, stretch wrapping, binding, or other similar process—that are efficient, economical, and able to operate within the space limitations of the enveloping machine. In some of the embodiments of the system and method, the motion of the corner post applicator is simplified, cutting corner post application time and/or reducing design and/or manufacturing costs. In other embodiments, corner posts of multiple different heights may easily be applied. In still other embodiments, the corner post supply devices are simplified, yet robust and adaptable to a customer's needs.

According to one embodiment, a corner post application system is provided that includes a conveyor subsystem, an enveloping machine, a swing arm, an applicator arm, a corner post gripper, and a controller. The conveyor subsystem is adapted to linearly move a load containing a plurality of units. The enveloping machine envelopes the plurality of units with a material such that the plurality of units are bound together and may be a stretch wrapping, stretch hooding, binding, or similar type machine. The enveloping machine is aligned with the conveyor subsystem such that the conveyor subsystem delivers the load to the enveloping machine. The applicator arm is coupled to the swing arm and adapted to move linearly. The corner post gripper is coupled to the applicator arm. The controller rotates the swing arm about a vertical pivot axis until a corner post attached to the corner post gripper is aligned with adjacent sides that define a corner of the load. Thereafter, the controller stops rotation of the swing arm about the vertical pivot axis and moves the applicator arm linearly toward the corner of the load until a first side of the corner post contacts a first one of the adjacent sides of the load and a second side of the corner post contacts a second one of the adjacent sides of the load. Optionally, the corner post may contact both sides of the loads simultaneously if the applicator arm and load size are aligned. A sensor may be included for detecting a corner of the load, with the controller rotating the swing arm based on detection by the sensor.

According to another embodiment, a corner post application system for applying corner posts to a load having at least two sides that define a load corner is provided. The system includes a corner post supply, a corner post applicator, and a controller. The corner post applicator moves corner posts from the corner post supply to the load corner. The controller rotates the corner post applicator about a vertical pivot axis until the sensor detects that an attached corner post is aligned with the load corner. The controller thereafter stops the rotation of the corner post applicator about the vertical pivot axis and moves the corner post completely linearly toward the load corner until contact is made between the corner post and the load. The controller may rotate the corner post applicator until the controller determines a retained corner post is aligned with the load corner, with the controller thereafter stopping rotation of the corner post applicator about the vertical pivot axis and moving the corner post completely linearly toward the load corner until contact is made between the corner post and the load. A sensor may be included for detecting a corner of the load, with the controller determining a retained post is aligned with the load corner based on detection by the sensor.

According to other embodiments, the sensor may detect the load corner by repetitively measuring a distance between the sensor and the load as the swing arm rotates and by determining when a minimum value for the distance is measured. A lifting subsystem may be provided that lifts a slip sheet positioned on top of the load prior to a corner post is moved into contact with the load. The corner post holder may include a carousel adapted to rotate about a vertical axis, and it may also hold the corner posts in a vertical orientation. The corner post holder may further include a plurality of separate holding units that are each adapted to frictionally retain a plurality corner posts, such as between first and second sets of brushes, and each holding unit may hold corner posts of different heights. One or more separate holding units may be included in each corner post holder. A plurality of carousel corner post holders may be associated with each swing arm or each corner post applicator. When multiple carousel corner post holders are present, the controller may be adapted to control the swing arm or corner post applicator so as to enable the corner post gripper to pick a corner post from one of the multiple corner post holders. The corner post holders may include sets of brushes that frictionally retain the corner posts therebetween, and the corner post holders may not include any powered actuators for linearly moving the corner posts. An extension guide may be coupled to the corner post gripper. The extension guide may extend horizontally farther than an attached corner post such that, during movement of the attached corner post toward the load, the extension guide will contact the load prior to the attached corner post if the first and second sides of the attached corner post are not aligned with the adjacent sides of the load. Additional sensors may be employed for determining the presence of a corner post within a corner post gripper, and in a carousel holder. Sensors may also be employed for sensing the orientation of a carousel holder for aligning with a corner post gripper.

According to another embodiment, a method of applying corner posts to a load that utilizes any of the various system embodiments described herein is provided. For example, the method may include conveying a load into an enveloping machine, sensing a distance to the load with a sensor mounted for rotational motion to a corner post applicator by rotating the sensor adjacent the load, determining the corner of the load based on said distance, and applying a corner post to the corner of the load with the corner post applicator, such as by linearly moving a vertical corner post. The method may further involve lifting a top sheet during applying the corner post and folding a bottom sheet after applying the corner post, as well as further involve holding the corner post in place until a top portion of the load is enveloped. Still further, the applying a corner post may comprise selecting a corner post from a carousel holder, such as by rotating the corner post applicator and extending a corner post gripper and grasping the corner post with a corner post gripper. Still further, the method may employ sensing the height of the load such as for selecting a corner post.

These and other objects, advantages, purposes and features of this invention will become apparent upon review of the following specification in conjunction with the drawings.

DETAILED DESCRIPTION OF THE EMBODIMENTS

Figure 1:
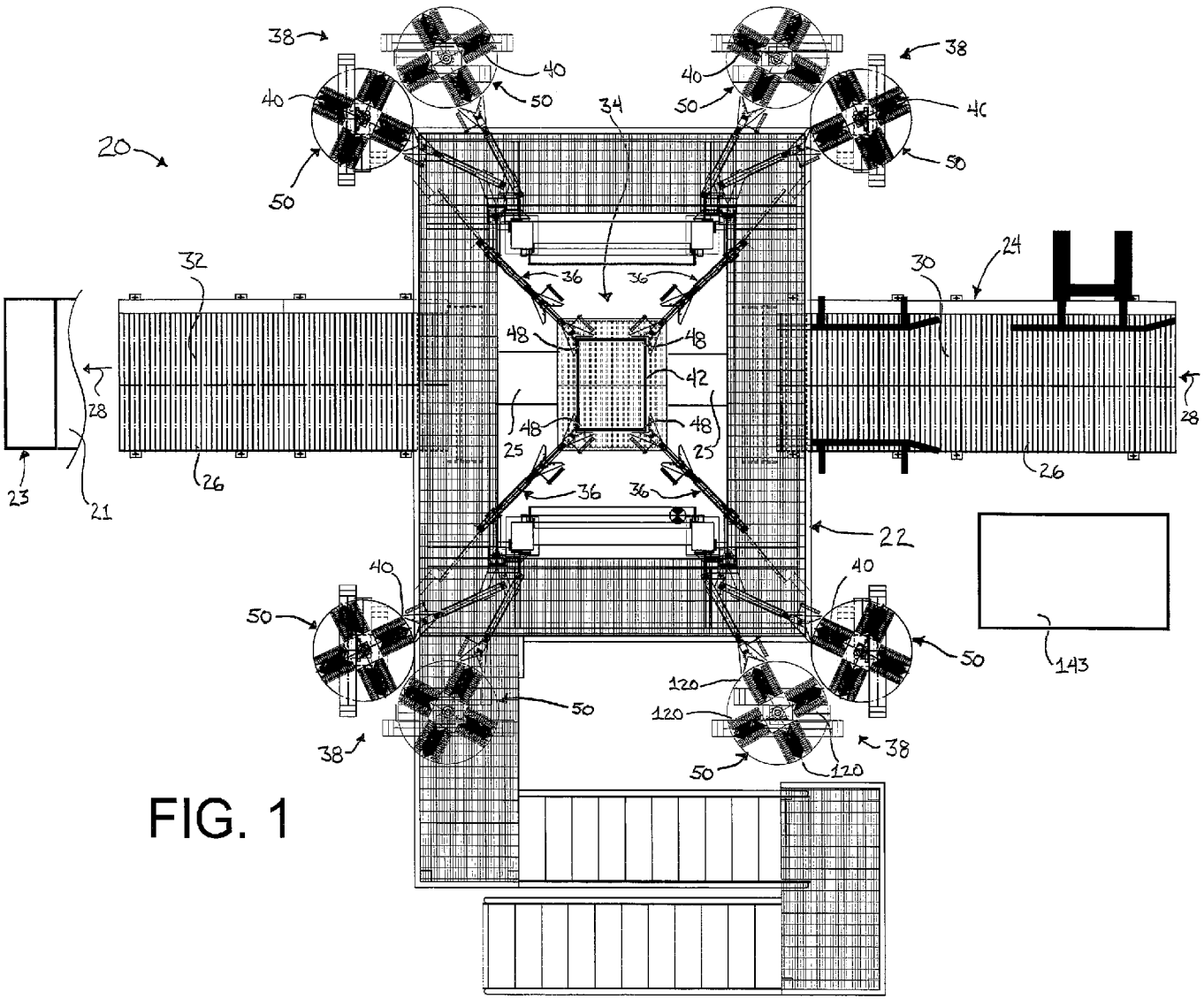
FIG. 1 is a plan view of an illustrative embodiment of a corner post application system that includes a stretch hooding machine and four corner post applicators.

A corner post application system 20 according to one embodiment is shown in plan view in FIG. 1. Corner post application system 20 includes an enveloping machine 22, which may be a stretch wrapping machine, a stretch hooding machine, a binding machine, or any other type of machine that is adapted to envelope a load 42 with a binding material. Corner post application system 20 is adapted to automatically place corner posts 40 on the load 42 prior to its being bound with material. Once bound, the corner posts 40 are held in place by the material and help bring stability and strength to the bundled plurality of individual units that make up the load 42.

In the embodiment depicted in FIG. 1, enveloping machine 22 is a stretch hooding machine that receives plastic hooding material 21 from film dispenser or applicator 23. While the various figures included herein all depict enveloping machine 22 as a stretch hooding machine, it will be understood by those skilled in the art that the principles disclosed herein are not limited to stretch hooding machines, but may be applied to any type of enveloping machine.

Figure 2:
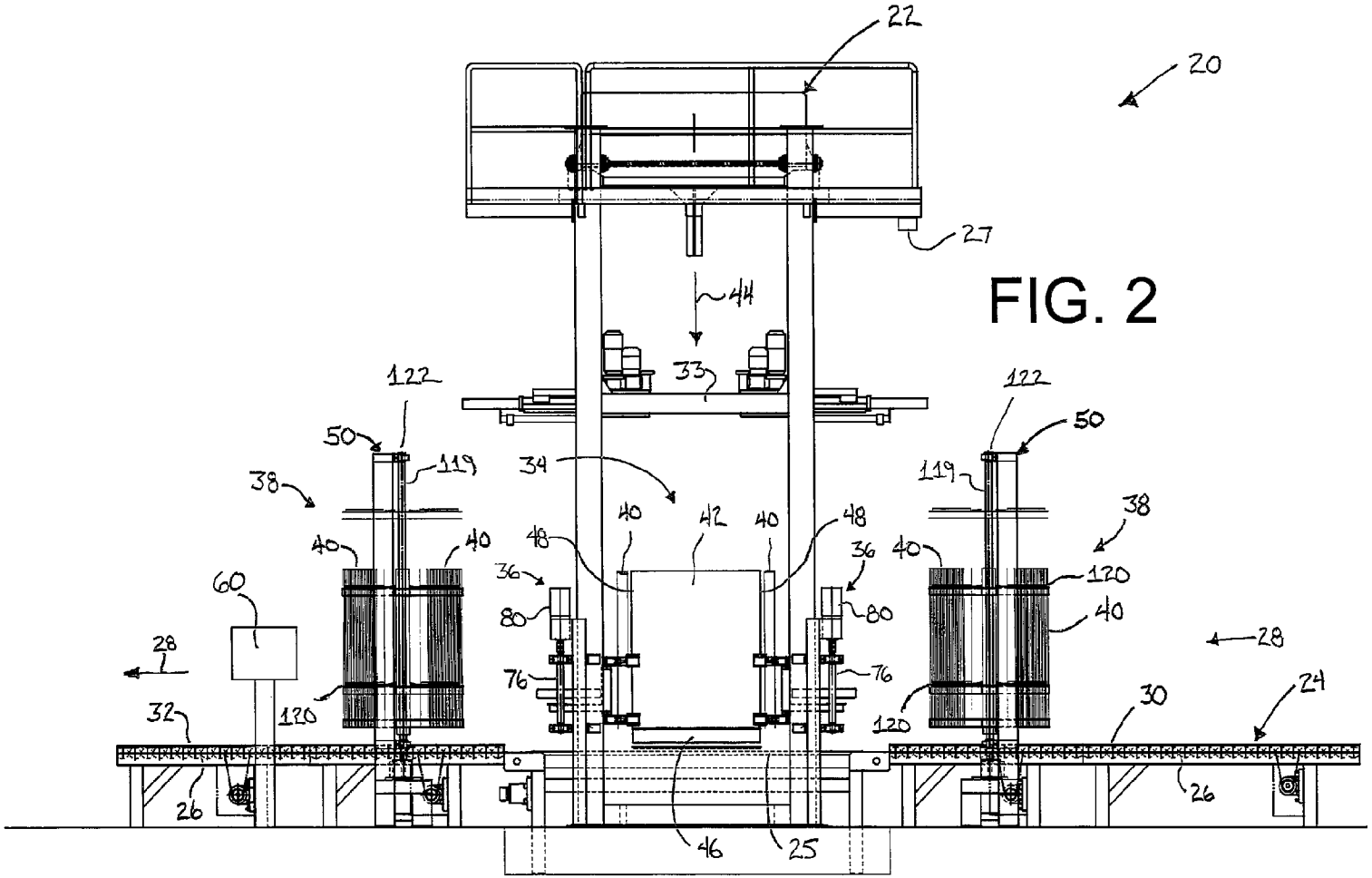
FIG. 2 is a side elevational view of the system of FIG. 1.
Figure 3:
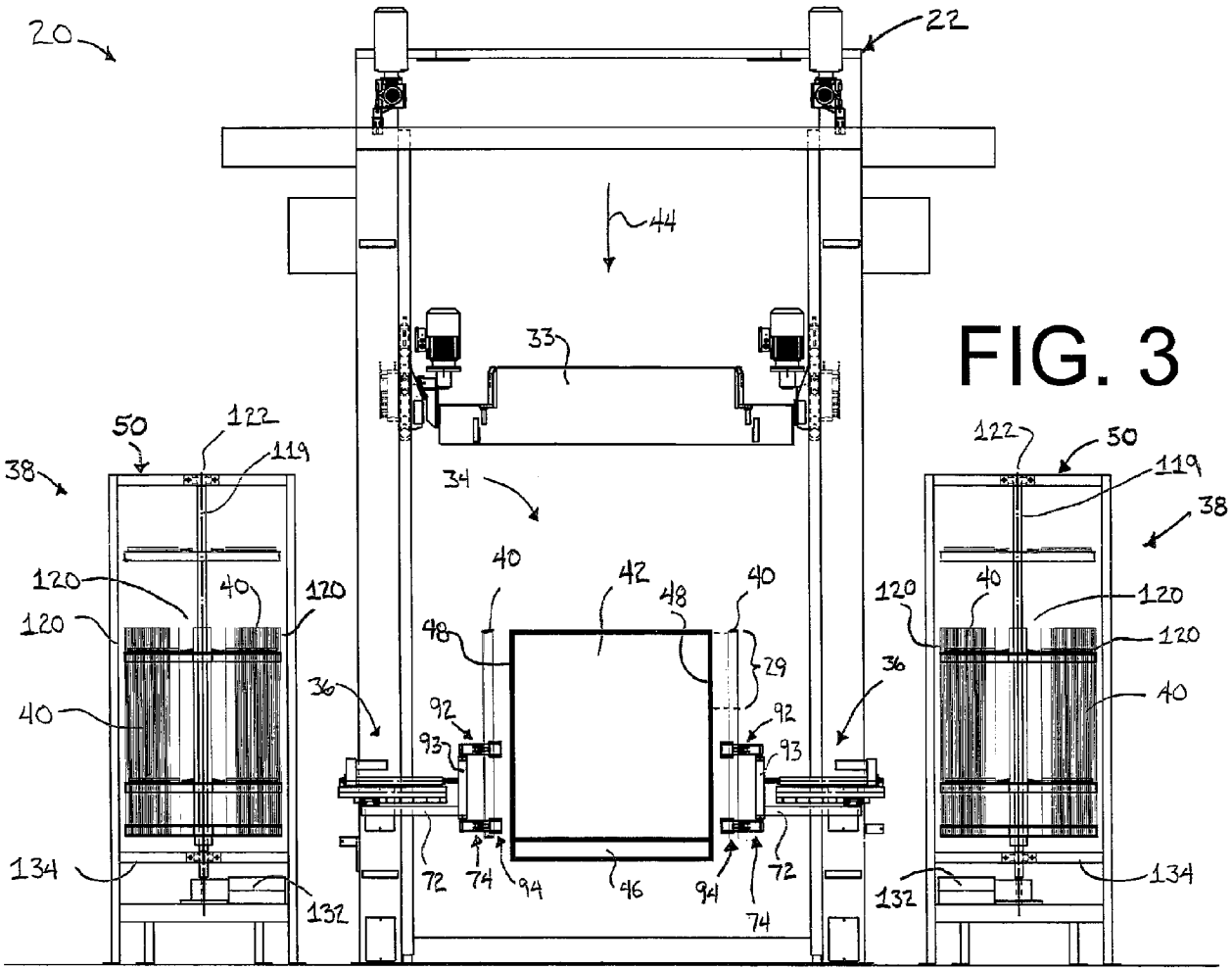
FIG. 3 is front elevational view of the system of FIG. 1.

Stretch hooding machine 22 may be a conventional stretch hooding machine, or a modified stretch hooding machine. In brief, a stretch hooding machine is adapted to pull a hood of flexible plastic material 21 down over a load 42 from top to bottom. That is, stretch hooder 22 pulls a hood down over load 42 in a downward direction 44, such as is shown in FIG. 2, via stretch hooder carriage 33. After the hood has been pulled down over the load 42, the tension on the hood is released, thereby causing the hood material—which may be any type of conventional plastic hooding material—to revert to its untensioned or less tensioned shape, which squeezes the load and binds the individual units of the load together. An example of a conventional stretch hooding machine 22 is the model HSA supplied by Millers North America, Inc. of Grand Rapids, Mich. The type of units that may be positioned on the load 42 is not limited by the present invention. As illustrative examples, the unit loads may be individual boxes of retail items, such as diapers, laundry soap, etc, or it may be bagged items, food, or a wide variety of other items.

Corner post application system 20 further includes a conveyor subsystem 24 that is adapted to move the load 42 to and from stretch hooding machine 22. Typically the load is made up of individual units that are stacked on top of a conventional pallet 46 (FIG. 2). Pallet 46 rides on rollers 26 of conveyor subsystem 24, which are powered and drive the load in the direction of arrow 28 (FIG. 1). Conveyor subsystem 24 includes an input section 30 and an output section 32. Input section 30 is where load 42 is moved toward enveloping machine 22 prior to load 42 being enveloped. Output section 32 is where load 42 is moved away from enveloping machine 22 after load 42 has been enveloped. Input section 30 thus delivers the load to enveloping machine 22 while output section 32 transports it away.

Stretch hooding machine 22 includes a hooding location 34 located generally in its middle where the stretch hooding material is applied to the load. Stretch hooder 22 may include a conveyor belt or system 25 (FIG. 19), or other known means, for moving the load to hooding location 34 after accepting the load from input section 30 of conveyor subsystem 24. The same conveyor belt or system 25, or other means, may then deliver the load to output section 32 after the stretch hooding operation has been completed.

Figure 4:
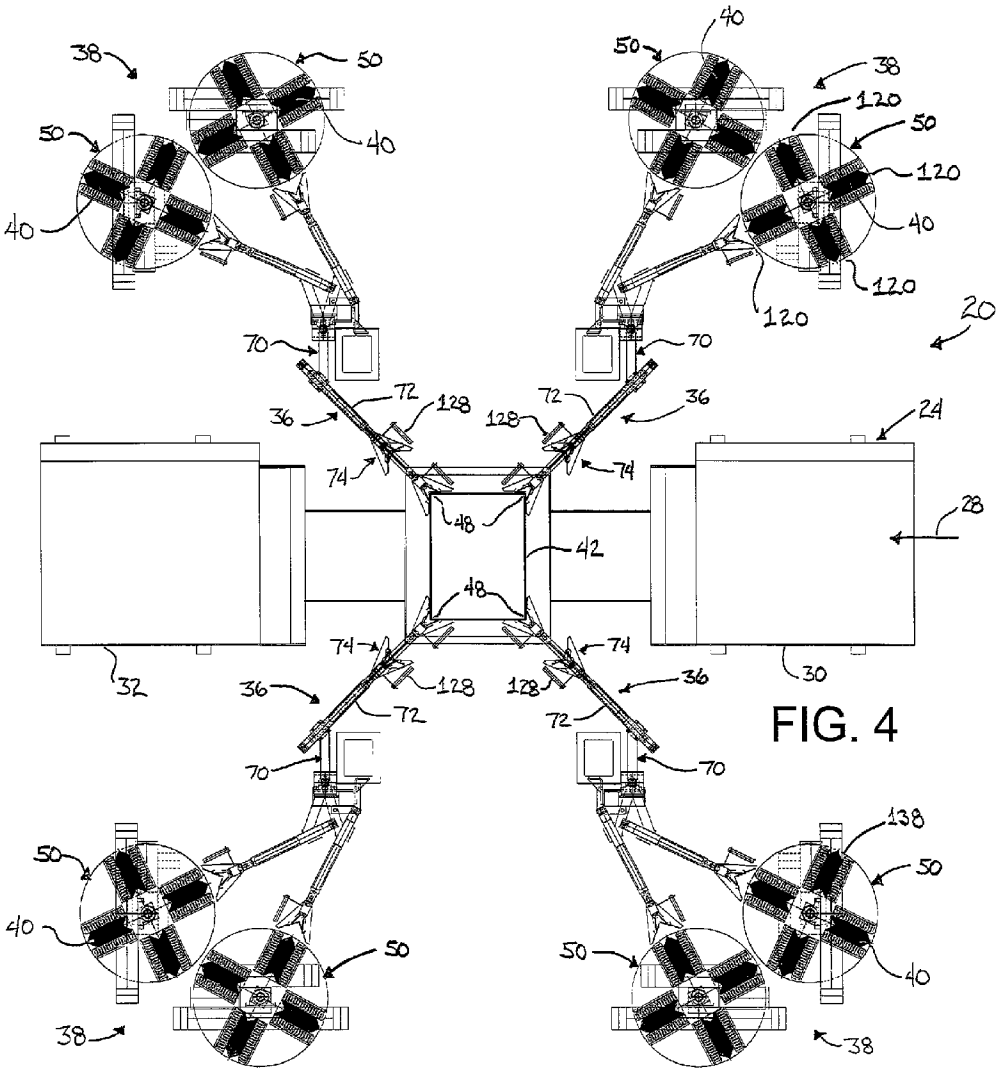
FIG. 4 is a plan view of the corner post application system that includes less detail regarding the stretch hooding machine and conveyor subsystem.
Figure 5:
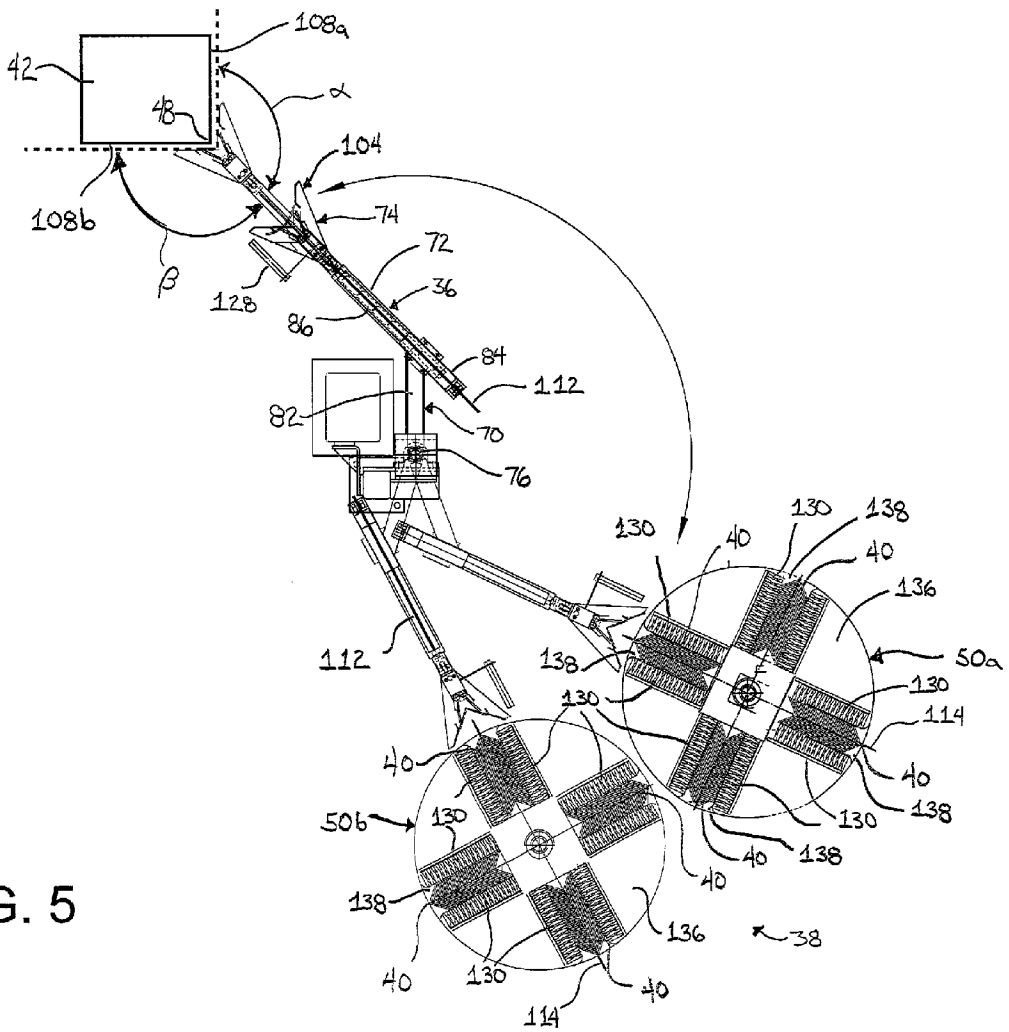
FIG. 5 is a plan view of a pair of corner post holders and corner post applicator from the system of FIG. 4 illustrating various positions through which the corner post applicator may move.
Figure 6:
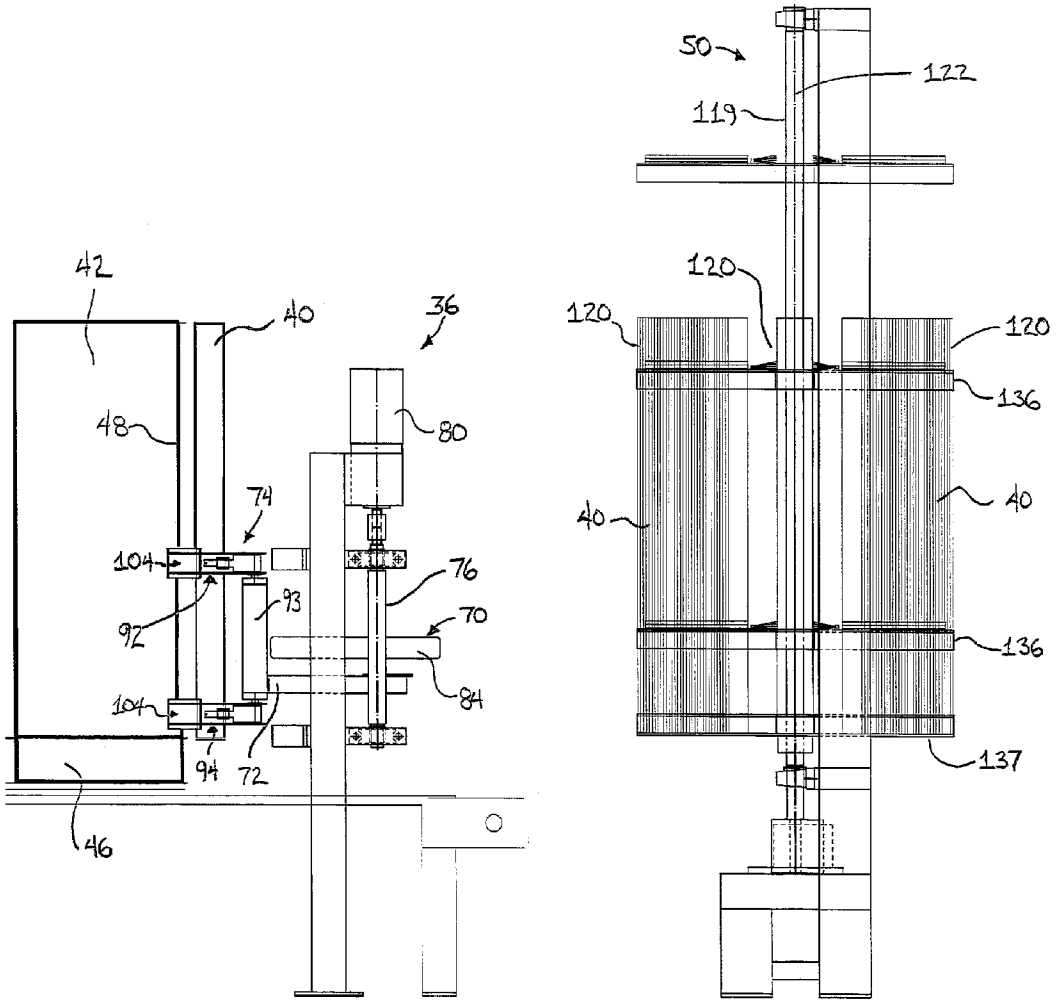
FIG. 6 is side elevational view of a corner post holder and applicator from the system of FIG. 4.
Figure 7:
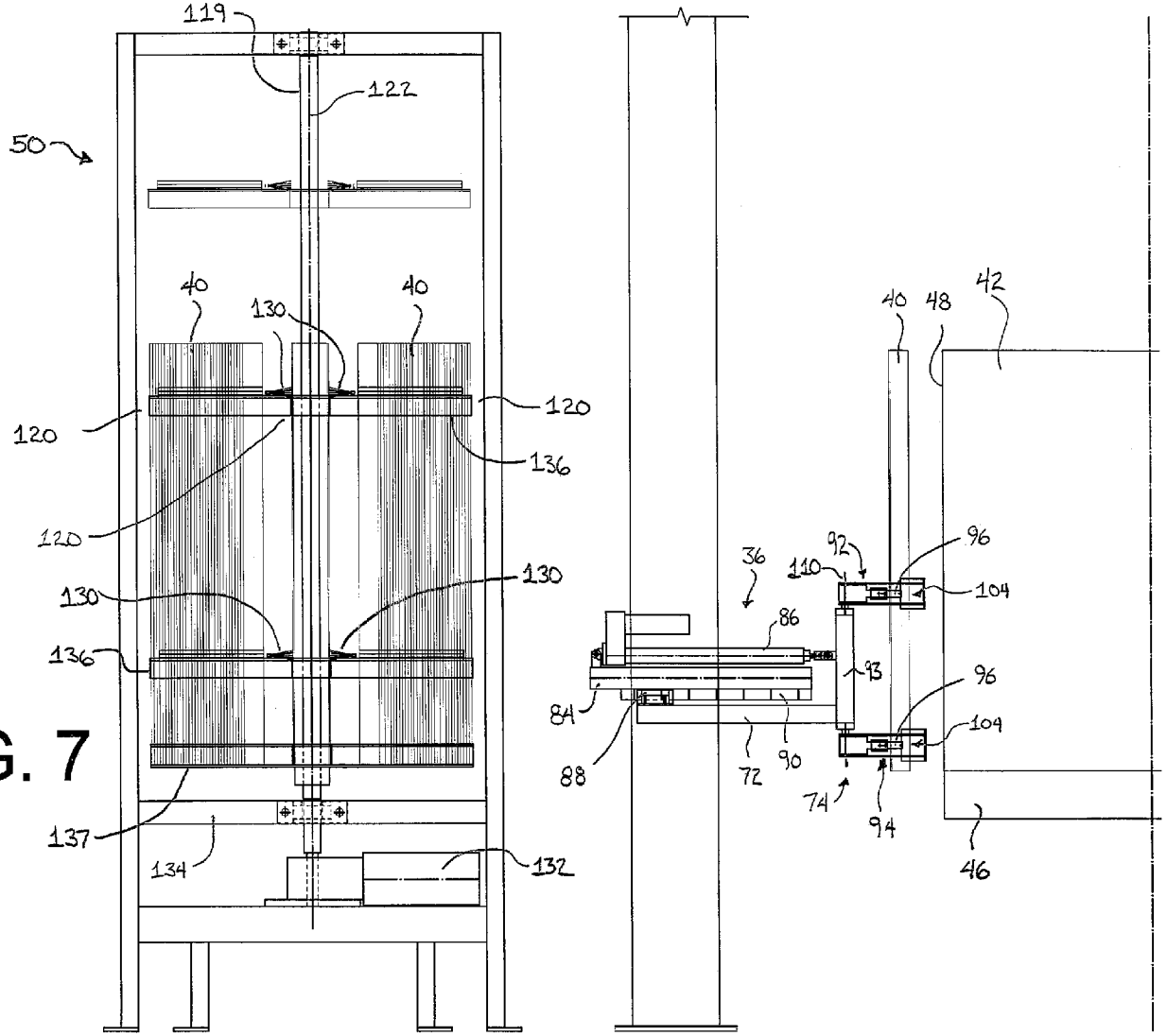
FIG. 7 is a front elevational view of the corner post holder and applicator of FIG. 6.

Corner post application system 20 further includes at least one corner post applicator 36 and at least one corner post supply 38. In many embodiments, such as that shown in FIGS. 1-4, four corner post applicators 36 may be included within system 20 wherein each corner post applicator 36 positions a corner post 40 at one of the four vertical edges—i.e. the corners 48—of the load. While a typical load will have four such corners 48, the principles disclosed herein would be fully applicable to loads that are shaped to have more than four, or less than four, corners. It should be appreciated that in the illustrated embodiment a single corner post applicator 36 is employed for each corner, with FIGS. 1, 4 and 5 illustrating the rotational movement of the corner post applicators 36 by way of the alternatively positioned corner post applicators 36.

Corner post supply 38 provides one or more stacks of corner posts 40 that are individually grabbed by one of the corner post applicators 36 and then moved into contact with a respective corner 48 of the load. In the embodiments shown in FIGS. 1-4, corner post supply 38 includes a pair of carousel holders 50 associated with each corner post applicator 36. It will be understood that the number of carousel holders 50 associated with each corner post applicator 36 can be varied to include only a single carousel holder 50, or two or more carousel holders 50. It will further be understood other types of corner post holders may be utilized other than the carousel holders 50 shown in FIGS. 1-4. The construction and operation of carousel holders 50 will be described in greater detail below with respect to FIGS. 12-14.

Figure 15:
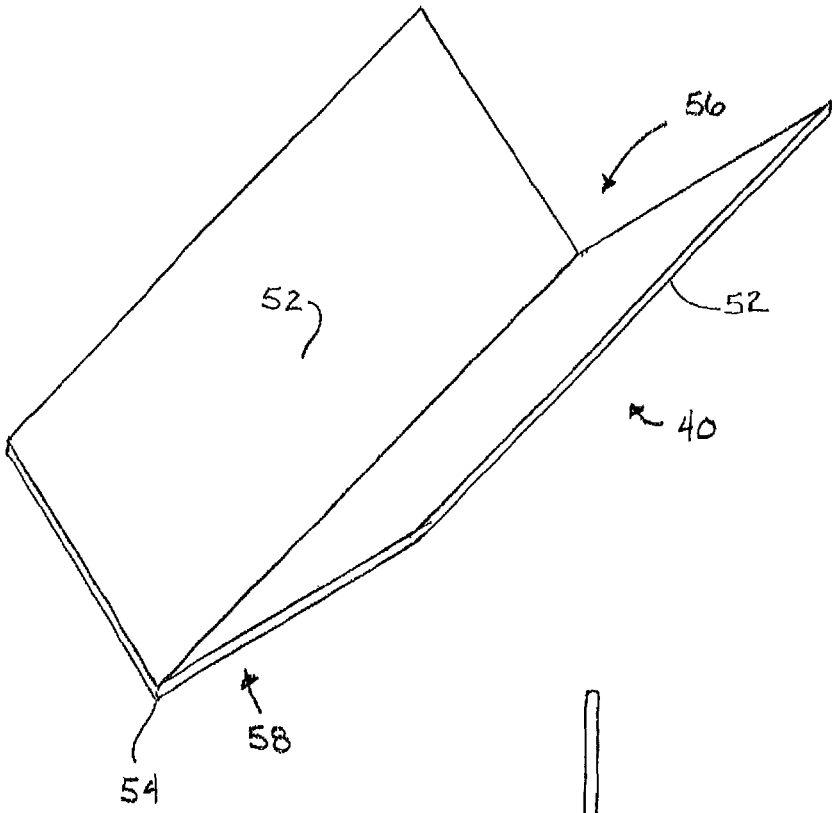
FIG. 15 is a perspective view of an illustrative corner post that may be used in any of the embodiments described herein.
Figure 16:
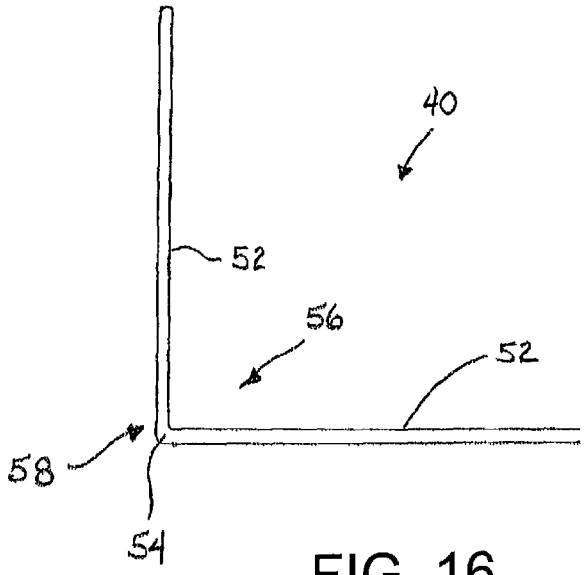
FIG. 16 is an elevational view of the corner post of FIG. 15.

The shape and construction of the corner posts 40 may vary from that shown in the accompanying drawings. One example of the shape of corner posts 40 is shown in FIGS. 15 and 16. As seen therein, corner posts 40 are generally V-shaped when viewed from either of their ends. This V-shape defines two sides 52 that are joined at an edge 54. Each side 52 includes an inside surface 56 and an outside surface 58. Inner surfaces 56 are the surfaces that will contact the corners 48 of load 42 when the corner posts are coupled thereto. Outer surfaces 58 will face away from the load 42 when the corner posts are coupled thereto. The angle between each side 52 may be approximately 90 degrees such that it generally matches the angle defined by the corners 48 of the load. However, in some embodiments, sides 52 of corner posts 40 may be joined together at non-right angles. In other embodiments, corner posts 40 may be curved and not include discrete sides. Other shapes are also possible.

Corner posts 40 may be made of any conventional material, such as, but not limited to, cardboard, fiberboard, or the like. In the various embodiments of system 20 described herein, corner posts 40 may have different heights or lengths to match loads 42 of different heights. Corner post applicator 36 is controlled to automatically select a corner post 40 of the appropriate length from corner post supply 38 that matches the height of the load currently about to undergo the stretch hooding process. The height of the load 42 about to undergo stretch hooding may be determined in known manners from a height scanning system associated with stretch hooding machine 22. The height scanning system may be located at a palletizer that determines the height when the load is placed on a pallet 46, with the height being transmitted via an Ethernet or other communication connection. Alternatively and/or additionally a height sensor 27 of such a system, such as an ultrasonic height sensor, may be mounted to stretch hooding machine 22 for measuring the height of load 42 as it enters into hooding location 34. This height is communicated to a controller 60 (FIG. 2) that controls the operation of each corner post applicator 36, as well as the corner post supply 38. If necessary, controller 60 will automatically rotate one or more of the carousel holders 50 such that a stack of corner posts 40 of the matching height face toward the associated corner post applicator 36. This will enable the corner post applicator 36 to pick a corner post from the holder 50 of a height that matches the height of the load about to be stretch hooded. This automated selection of corner posts of the correct height enables corner post applications system 20 to process successive loads of different height without requiring any human intervention to ensure that the proper corner posts are applied to the load.

Figure 8:
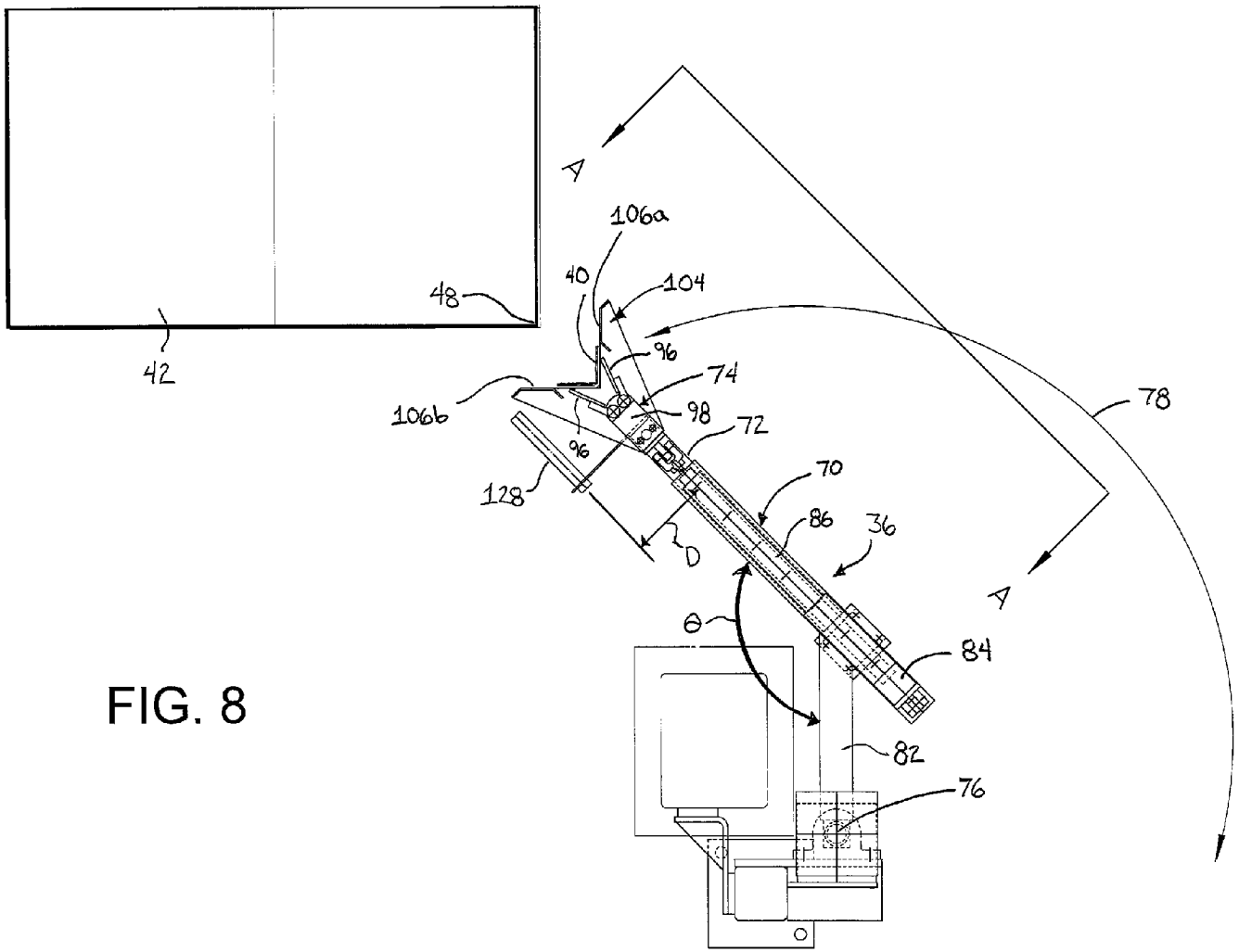
FIG. 8 is a plan view of a corner post applicator according to one embodiment showing some of the possible movement of the applicator.
Figure 9:
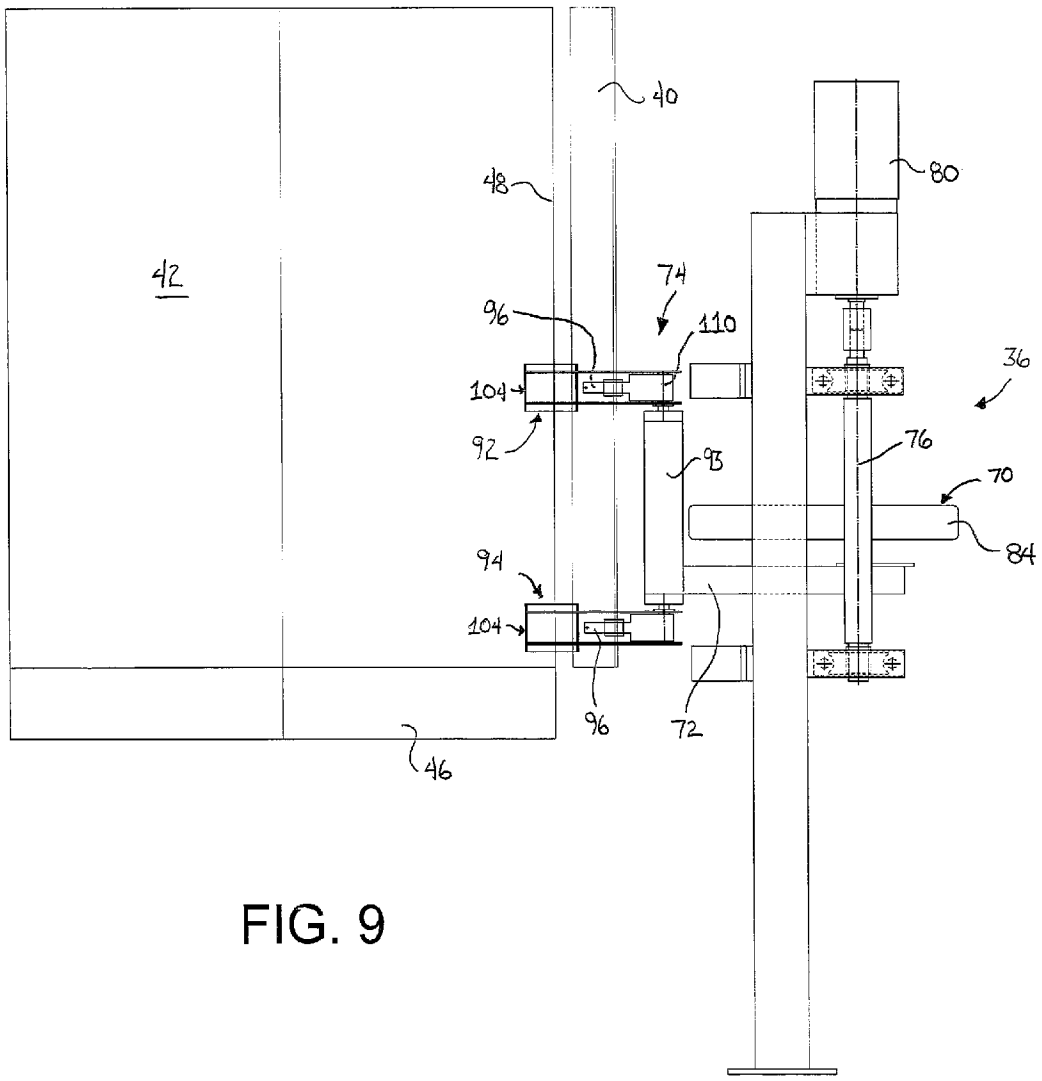
FIG. 9 is a side elevational view of the corner post applicator of FIG. 8.

As shown more clearly in FIGS. 8-11, each corner post applicator 36 includes a swing arm 70, an applicator arm 72, and a corner post gripper 74. Swing arm 70 is rotatably coupled to a vertical rotation pivot shaft 76 (FIG. 9) that defines a vertical axis about which swing arm 70 may rotate. This freedom of rotation is illustrated in FIG. 8 and identified by rotational arc 78. The rotation of swing arm 70 about pivot shaft 76 is automated by an actuator 80 (FIG. 8) that operates under the control of controller 60.

Swing arm 70 includes a first section 82 and a second section 84 that are joined together at an angle theta (θ) (FIG. 8), The magnitude of angle theta may be varied to match the dimensions of the stretch hooding machine 22 and the available clearance for swing arm 70 as it moves through rotational arc 80. In some embodiments, theta may have an angle of zero degrees, in which case first and second sections 82 and 84 of swing arm 70 will essentially be combined into one straight piece.

Applicator arm 72 is coupled to second section 84 of swing arm 70 in such a manner that applicator arm 72 may move linearly in a direction parallel to the longitudinal extent of second section 84 of swing arm 70. This linear movement allows a corner post 40 attached to corner post gripper 74 to be brought into contact with a corner 48 of load 42. This linear movement is effectuated by an actuator 86, which may comprise a servo driven linear positioner, such as shown in FIGS. 10 and 11, or any other suitable type of actuator.

Figure 10:
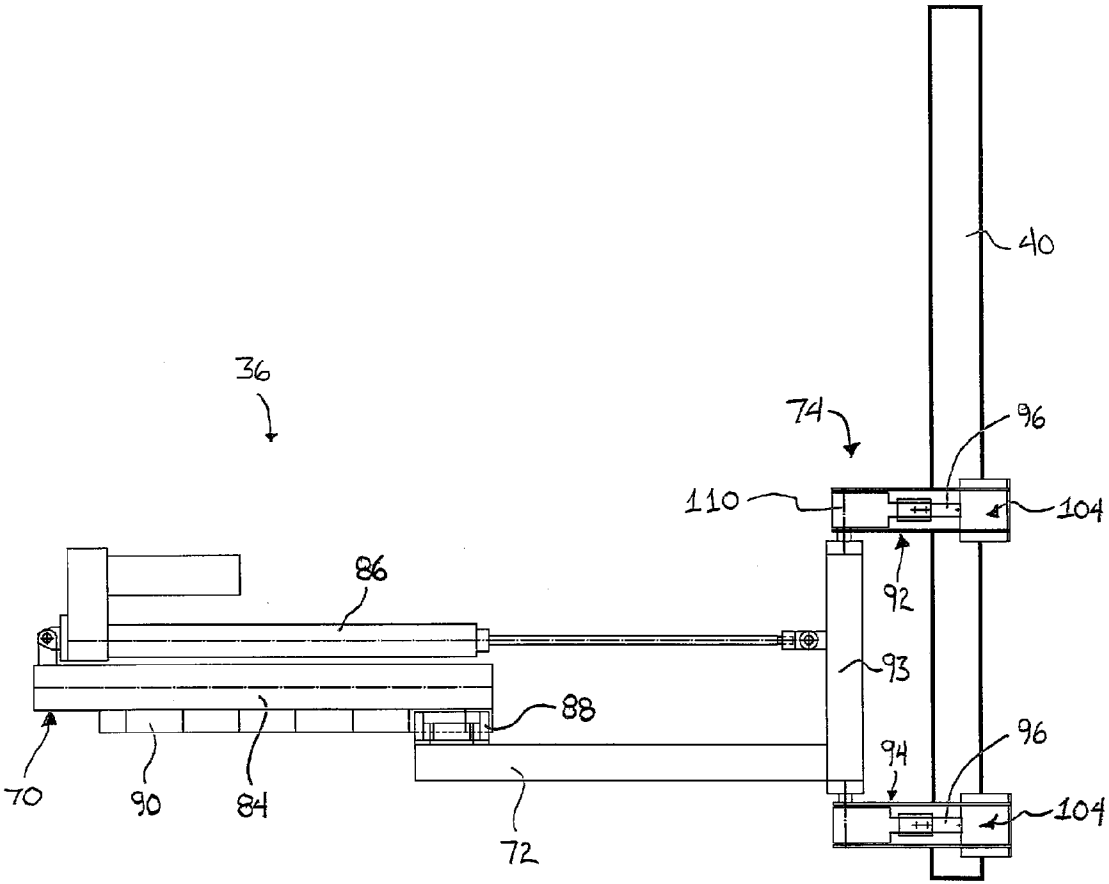
FIG. 10 is an elevational view taken from the perspective of line A-A of FIG. 8 showing the corner post applicator in its extended position.
Figure 11:
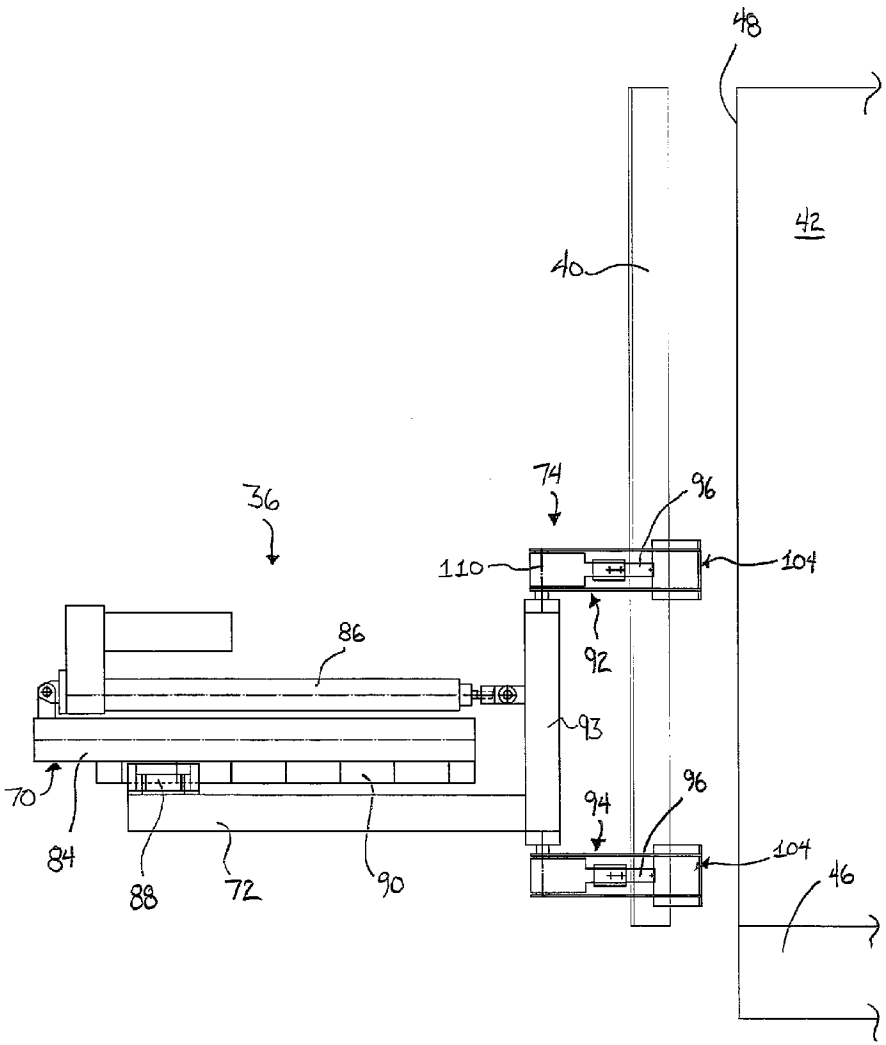
FIG. 11 is an elevational view of the corner post applicator of FIG. 8 taken from the perspective of line A-A of FIG. 8 and showing the corner post applicator in its retracted position.

While other constructions are possible, applicator arm 72, as shown most clearly in FIGS. 10 and 11, includes a linear bearing 88 fixedly attached to applicator 72 at one of its ends opposite to corner post gripper 74. Linear bearing 88 is constructed to translate along a linear rail 90 coupled to the underside of second section 84 of swing arm 70. This construction allows applicator arm 72 to move between a fully retracted position illustrated in FIG. 11, and a fully extended position illustrated in FIG. 10. Under the control of controller 60, actuator 86 will drive applicator arm 72 toward load 42 until the attached corner post 40 contacts the adjacent corner 48 of load 42.

Figure 17:
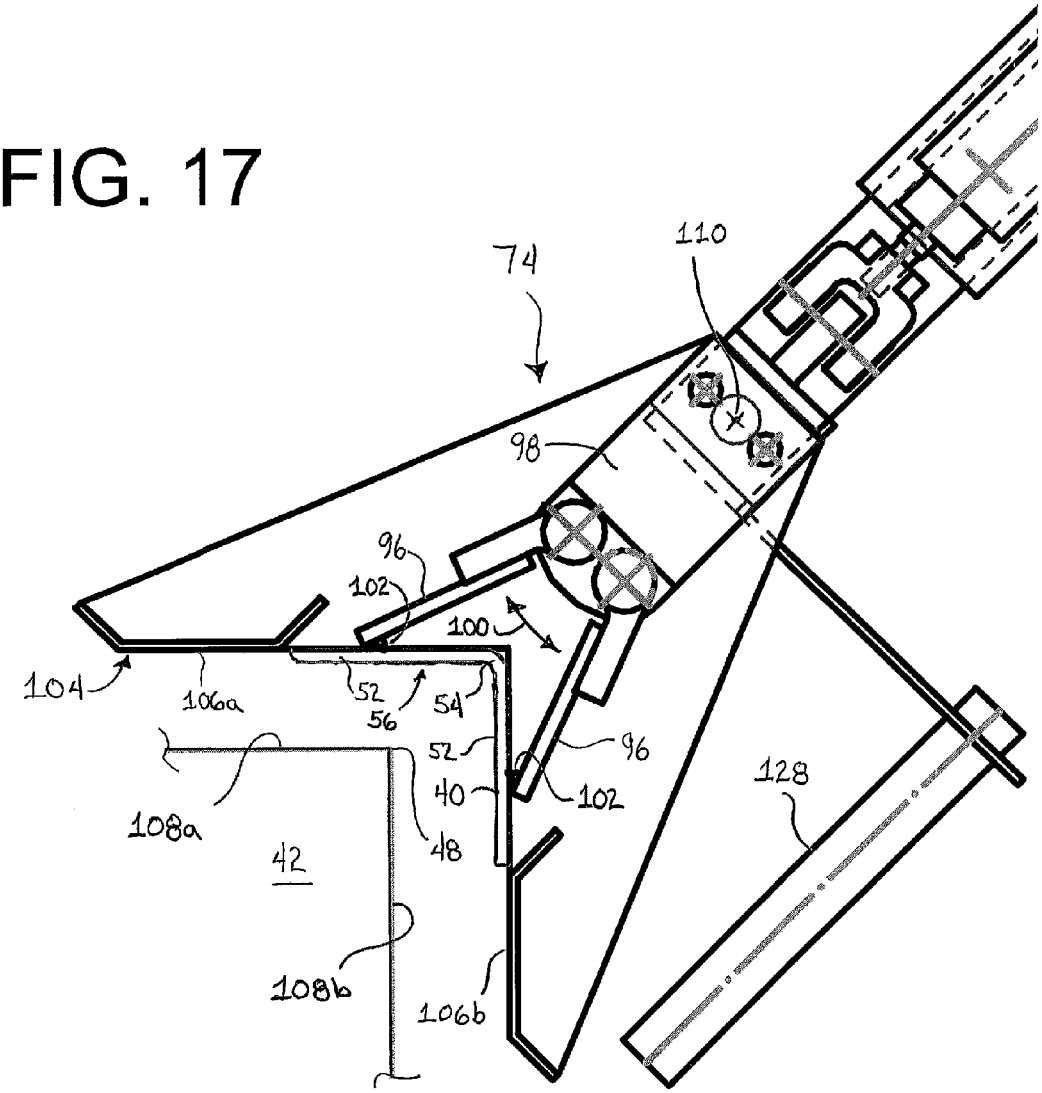
FIG. 17 is a close up view of a corner post gripper and sensor attached to an applicator arm.

Each corner post gripper 74, as shown in various of the drawings, including FIGS. 6-7 and 9-11, includes a top gripper 92 and a bottom gripper 94 that are vertically spaced and affixed together, such as by a vertical rotation pivot shaft 93. Additional grippers may be used, if desired. The individual grippers may comprise suction cups, Venturi-activated devices, or other conventional gripping mechanism, as would be known to one of ordinary skill in the art. In the embodiments depicted in the drawings, each gripper 92 and 94 includes a pair of fingers 96 that are best illustrated in FIG. 17. An actuator 98 is coupled to fingers 96 and selectively moves fingers 96 toward and away from each other in a pinching fashion generally illustrated by arrow 100 of FIG. 17. Each finger 96 includes a sharp projection or point 102 that is sharp enough to at least partially penetrate into the exterior surface 58 of a corner post 40 to thereby grip the corner post securely enough for movement out of corner post supply 38 to the corner of the load.

The operation of actuator 98 is also under the control of controller 60. Controller 60 will pinch fingers 96 toward each other when applicator 36 is picking up a corner post from one of carousel holders 50, Thereafter, the fingers 96 will remain pinched together while applicator 36 delivers the corner post to the load. Still further, controller 60 will keep fingers 96 pinched together until the stretch hooding material envelopes a top portion of the load, as well as a top portion of each corner post 40 (see top portion 29 illustrated in FIG. 3). At this point, controller 60 will direct actuator 86 to move fingers 96 away from each other, thereby releasing the attached corner post from gripper 74 and allowing applicator 36 to move out of the way of the stretch hooding operation. The partial envelopment of the top of the load and the tops of corner posts 40 by the stretch hooding material will prevent the corner posts from falling away from the load after their release by corner posts grippers 74 but prior to the completion of the full stretch hooding operation. In other words, the stretch hooding material will hold the corner posts adjacent the load during the interim period between the release of the corner posts by grippers 74 and the full envelopment of the load by the stretch hooding material.

Each corner post gripper 92 and 94 includes an extension guide 104 attached to it (FIG. 17). Extension guides 104 extend outwardly from corner posts 40 a greater amount than the outermost reaches of corner posts 40. Extension guides 104 include a first guidewall 106*a* and a second guidewall 106*b*. The purpose of extension guides 104 is to help align the corner post 40 with the load corner 48 as the corner post 40 is moved into abutment with the load corner 48. As shown in FIG. 17, each side 52 of corner post 40 is parallel to a corresponding side 108 of load 42. Further, guidewall 106*a* is parallel to side 108*a* of load 42, and guidewall 106*b* is parallel to side 108*b* of load 42. In this orientation (FIG. 17), guidewalls 106*a* and 106*b* do not help align the corner post 40 with the load since the corner post is already aligned therewith.

However, if the corner post 40 is not perfectly aligned with the load corner 48, then one of guidewalls 106*a* or 106*b* will come into contact with one of sides 108*a* and 108*b* of the load 42 prior to one of sides 52 of corner post 40. The contact between one of guidewalls 106 and load sides 108 will cause corner post gripper 74 to pivot about a vertical pivot axis 110 of shaft 93 until the corner post 40 (and guidewalls 106) are aligned with the load sides 108. This pivoting will occur due to the force of actuator 86 that linearly moves applicator arm toward the load 42. No actuator needs to directly or separately control the pivoting about pivot axis 110. In some embodiments, springs or other resistive means may be included to dampen and/or reduce any looseness in the freedom of corner post gripper 74 to pivot about pivot axis 110. Such dampening or resistivity will prevent corner post gripper 74 from freely pivoting in the absence of a force created by contact with the load. Further, such dampening and/or resistivity will cause corner post gripper to pivot back about axis 110 to its default position after the release of the corner post and movement of applicator arm 72 away from the load 42.

The movement of corner post applicator 36 in transferring a corner post 40 from corner post supply 38 to a load 42 will now be described. This movement is best understood with reference to FIGS. 5 and 8. When it is time to retrieve a corner post 40 from corner post supply 38, controller 60 will rotate swing arm 70 about its vertical rotation pivot shaft 76 until second section 84 of swing arm 70 is parallel to the corner posts 40 held in one of carousel holders 50. In other words, as can be seen in FIG. 5, swing arm 70 will rotate about shaft 76 until a line 112 representing the longitudinal extent of second section 84 of swing arm 70 is parallel and aligned with a line 114, which represents the direction in which the corner posts 40 are stacked next to each other in carousel holder 50.

As can be seen in FIG. 5, the amount of angular rotation about shaft 76 will depend upon which carousel holder 50 applicator 36 is retrieving a corner post 40 from. Greater rotation will be required to retrieve a corner post 40 from holder 50*b* than from 50*a*. The choice of which carousel 50*a* or 50*b* to retrieve a corner post 40 from may be based upon several factors under the control of controller 60. If carousel 50*a* holds corner posts 40 of a first height and carousel 50*b* holds corner posts 40 of a second height, then controller 60 will direct the rotation of swing arm 70 about shaft 76 until alignment is reached with the carousel holding the corner posts 40 of the same height as that required by the next load to be stretch hooded.

Alternatively, if each carousel holds corner posts 40 of the same height, then controller 60 may direct the rotation of swing arm 70 about shaft 76 such that corner posts 40 will first be repetitively retrieved from one of the holders 50 until it is completely depleted of corner posts 40, and then move to the second holder where corner posts 40 will be repetitively retrieved until that holder is completely depleted. Other controls schemes may also be used.

As another alternative, corner posts 40 of different heights may be placed in the same carousel holder 50. As can be seen in the various figures, each carousel holder 50 includes four separate holding units 120. Each holding unit 120 may hold a set of corner posts 40 of a specific height. Thus, each holder 50 may hold four sets of corner posts 40 that each have a different height. Alternatively, each holder 50 might include three holding units 120 having different height corner posts 40 and one unit 120 having a height common to one of the other three units 120 for a total of three different corner post heights. As another alternative, each holder 50 might include a total of two different corner post heights, two of a first height placed in two holding units 120 and two of a second height placed in the other two holding units 120. Still other variations are possible.

Controller 60 controls the rotation of carousel holders 50 and is programmed to know what the heights are of the corner posts 40 in each holding unit 120. Further, controller 60 may be programmed to monitor the number of corner posts 40 retrieved from a given holding unit such that it can determine when a holding unit is empty. Controller 60 will automatically rotate each carousel holder 50 about a vertical axis 122 of a shaft 119 as necessary in order to ensure that a non-empty holding unit 120 having corner posts of the correct height will be aligned with line 114 and facing toward corner post applicator 36. As noted earlier, controller 60 may determine which height of corner post 40 is necessary for a given load based upon information received from an automatic height scanning system, such as determined via sensor 27.

With reference back to FIG. 5, after second section 84 of swing arm 70 is aligned line 114 of an associated carousel holder, controller 60 will direct actuator 86 to cause applicator arm 72 to move linearly toward the associated carousel holder until corner post gripper 74 comes into contact with a corner post held within the associate carousel holder. At that point, controller 60 will terminate the linear movement of applicator arm 72 and direct actuator 98 to cause fingers 96 to pinch together, thereby grasping a corner post between fingers 96. After fingers 96 have secured a corner post 40, controller 60 will activate actuator 98 in a reverse manner such that applicator arm 72 will move linearly away from carousel holder. At some point during this retraction of applicator arm 72, controller 60 may simultaneously start pivoting swing arm 70 about pivot shaft 76 in a counterclockwise direction (as viewed in FIG. 5 or 8). The precise moment when this counterclockwise rotation starts may be dependent upon clearance issues in the particular environment in which the system 20 is installed. In some cases, it may be necessary to wait until applicator arm 72 is fully retracted before rotating swing arm 70. In other cases, simultaneous retraction and rotation may occur for at least some moments.

The counterclockwise rotation of swing arm 70 (FIG. 5 or 8) about vertical shaft 76 continues until the longitudinal extent of second section 84 of swing arm 70 is pointed directly at the load corner 48 to which the corner post is going to be delivered. In other words, this rotation will occur until line 112—when extended outwardly, intersects the corner 48 of the load. In some embodiments, this intersection will occur when an angle alpha ($\alpha$) (FIG. 5) defined between one side 108*a* of the load 42 and the longitudinal extent of second section 84 is equal to substantially 135 degrees. In this case, if the load 42 has square sides, then the angle beta ($\beta$) (FIG. 5) defined between the other side 108*b* of the load 42 and the longitudinal extent of second section 84 will also be substantially equal to 135 degrees. However, in some embodiments, the angle alpha may be something other than 135 degrees, in which case the angle beta will not be equal to alpha (assuming the load has square corners).

After controller 60 has rotated swing arm 70 counterclockwise (FIG. 5 or 8) such that the longitudinal extent of second section 84 points at an adjacent corner 48 of the load 42, controller 60 will cease rotation about vertical pivot shaft 76. Either before or after this cessation of rotation about vertical pivot shaft 76, controller 60 will send signals to actuator 86 causing it to linearly move applicator arm toward load 42. The precise moment at which actuator 86 is activated may vary. In some embodiments, actuator 86 may not be activated until the rotation about pivot shaft 76 stops. In other embodiments, the actuator 86 may commence linear movement of applicator arm 72 prior to the full cessation of rotation about shaft 76. In still other embodiments, controller 60 may vary the moment at which it activate actuator 86 for linear movement depending upon known clearance and/or a known size of the load that is undergoing stretch hooding.

The linear movement of applicator arm 72 toward load 42 continues until the attached corner post 40 abuts against the load 42. At that moment, controller 60 stops actuator 86 and waits until it receives a signal from stretch hooding machine 22, or another suitable sensor, that indicates that the stretch hooding material has been placed over a top portion of the load 42. When this signal is received, as was described above, controller 60 directs actuator 98 to move fingers 96 apart from each other, thereby releasing corner post 40. After this release, controller 60 activates actuator 86 in a reverse direction causing applicator arm 72 to linearly retract away from load 42, thereby providing clearance for the stretch hooding operation to continue for enveloping the sides of the entire load.

As was noted, the clockwise movement (FIG. 5 or 8) of swing arm 70 about vertical pivot shaft 76 continues until second section 84—or applicator arm 72, which is aligned with second section 84—points in a direction that intersects the load corner. This moment is determined by a sensor 128 that may be attached to applicator arm 72, or another suitable structure. Sensor 128 may be any conventional sensor that detects distance, such as, but not limited to, a sensor that emits an electromagnetic wave and measures the amount of time necessary for the reflected wave to be detected. Other types of sensors may also be used.

Sensor 128 determines the moment when line 112 intersects a load corner by repetitively measuring its distance from load 42. Initially, this measurement will be of the distance between sensor 128 and side 108*a* of the load. As rotation of swing arm 70 about axis 76 continues, this distance will decrease because the measurements between sensor 128 and side 108*a* will be of measurements between a point on side 108*a* that will move toward the load corner as swing arm 70 rotates. This is because sensor 128 is coupled to swing arm 70 via applicator arm 72. The direction in which sensor 128 is aimed will therefore change as arm 70 rotates. At some point during this rotation, the sensor 128 will become directly aligned with the load corner and the distance it detects will be a minimum. Any further rotation, which may occur, will result in sensor 128 measuring its distance from side 108*b*. As further rotation occurs, the point along side 108*b* that sensor 128 is aimed will move further and further away from the load corner, thereby increasing the measured distance. By monitoring when the minimum distance is detected by sensor 128, controller 60 knows when to terminate the rotation of swing arm 70 about shaft 76. For example, in operation sensor 128 continually measures the distance to load 42 as arm 70 rotates, which distance will decrease to a minimum when arm 70 aligns gripper 74 with corner 48 of load 42 and will then increase as arm 70 continues to rotate gripper 74 past corner 48. Controller 60 monitors this distance and upon detecting that the distance is increasing stops rotation of arm 70 and rotates arm 70 in the counter direction until gripper 74 is re-positioned at the point of minimum measured distance, at which point arm 70 stops rotation in the counter direction and controller 60 activates actuator 86 to position corner post 40 against corner 48 of load 42.

In some embodiments, sensor 128 may be offset from the longitudinal extent of second section 84 by a known distance D, such as is shown in FIG. 8. By knowing this distance, controller 60 may be programmed to be able to stop the rotation of swing arm 70 about shaft 76 at precisely the moment of alignment with the load corner without having to reverse the rotation of swing arm 70 about vertical shaft 76. In other embodiments, controller 60 may rotate swing arm 70 past the corner, stop the rotation, and then commence a rotation in a clockwise direction (FIG. 5 or 8) until alignment is reached.

In some embodiments, a top and/or bottom slip sheet may be placed upon the load prior to undergoing the stretch hooding operation. For example, a bottom slip sheet may be placed on a pallet 46 prior to the load being stacked thereon, with a top sheet being placed on top of the load 42 after pallet 46 is loaded, such as by a top sheet dispenser 143 (FIG. 1) that may lift top sheets on via vacuum cups or the like. In such embodiments, slip sheets may be constructed of corrugated cardboard, Kraft paper, plastic material, or the like and may have an overall length and width that are greater than the footprint of the load, such as with flaps extending beyond the vertical planes of the sides of load 42. This excessive length and width is deliberately planned so that, during the stretch hooding operation, the excessive length and width, or flaps, of the top slip sheet are folded down over the load by the stretch hooding material. In such situations, however, the excessive length and width of the top slip sheet may interfere with the placement of the corner posts on the load. In order to avoid this interference, a separate lifting mechanism may be provided that lifts the slip sheet off of the top of the load several inches (or whatever height is desired for proper clearance) during the placement of the corner posts against the corners of the load. Once the corner posts are placed on the corners, the top slip sheet may then be lowered back on top of the load. Thereafter, the stretch hooding operation may commence in its normal fashion. With respect to the bottom slip sheet, the excessive length and width, or flaps, must be folded against the load by a folding mechanism prior to the stretch hooding material being applied.

Figure 18A:
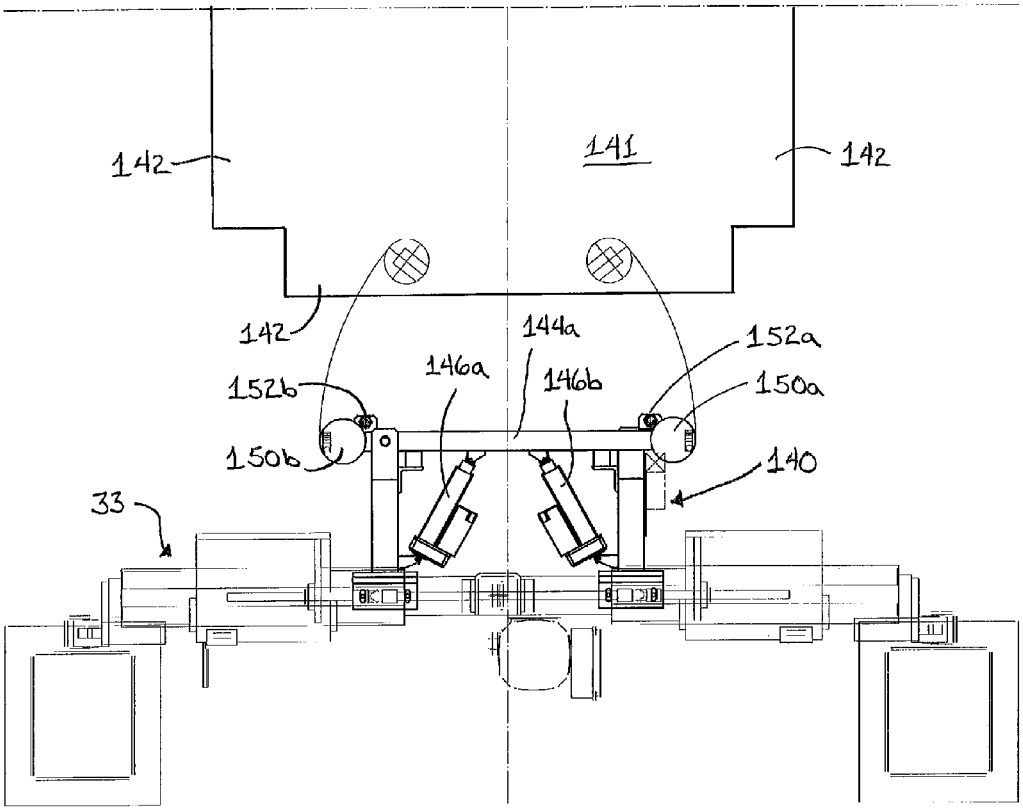
FIG. 18A is a partial top plan view of a stretch hooding carriage incorporating an illustrative embodiment of a top sheet lifter mechanism.
Figure 18B:
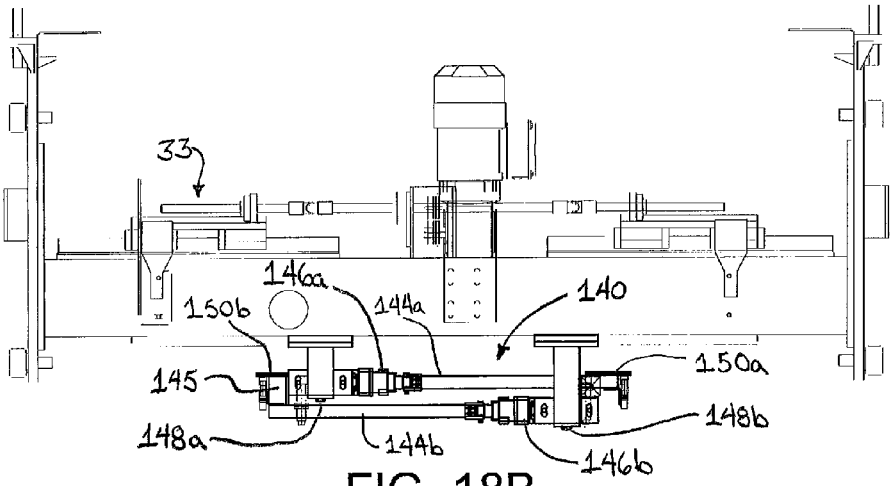
FIG. 18B is a side elevational view of the stretch hooding carriage of FIG. 18A.

An example of a lifting subsystem or mechanism 140 for lifting the top slip sheet 141 having flaps 142 from the top of the load is illustrated in FIGS. 18A and 18B. Lifting mechanism 140 is mounted to stretch hooding carriage 33, which is only partially shown in FIGS. 18A and 18B. It should be appreciated that one or more such lifting mechanisms 140 may be affixed to a stretch hooding carriage 33 to be disposed on the opposite or additional sides, respectively, of top sheet 141. Lifting mechanism 140 includes a pair of pivoting arms 144*a*, 144*b*, with arm 144*a* being positioned vertically above arm 144*b*. Actuators 146*a*, 146*b* are mounted to each arm 144*a*, 144*b*, respectively, and to carriage 33 such that extension of each actuator 146 causes arms 144 to pivot. Each arm 144*a*, 144*b* is mounted via a pivot bearing 148*a*, 148*b* at one end with a lift pad 150*a*, 150*b* located at the distal end, respectively, with arm 144*b* including an extender 145 such that both lift pads 150*a*, 150*b* are aligned with respect to a horizontal plane. Each arm 144*a*, 144*b* further includes a sensor 152*a*, 152*b*, such as a photo eye, adjacent the associated lift pad 150. In operation, a load having a top sheet 141 thereon is initially transported into hooding location 34 and controller 60 lowers carriage 33, with actuators 146 initially retracted, based on the detected height of the load such that lift pads 150 are positioned at a lower vertical elevation than top sheet 141. Controller 60 then causes actuators 146 to extend, thereby causing arms 144 to pivot such that lift pads 150 are positioned beneath the flap 142 of top sheet 141 extending beyond the side of the load. Sensors 152 are used to detect that lift pads 150 are under top sheet 141 and carriage 33 is then moved vertically upward to lift top sheet 141 from load while corner posts 40 are applied thereto.

Figure 19A:
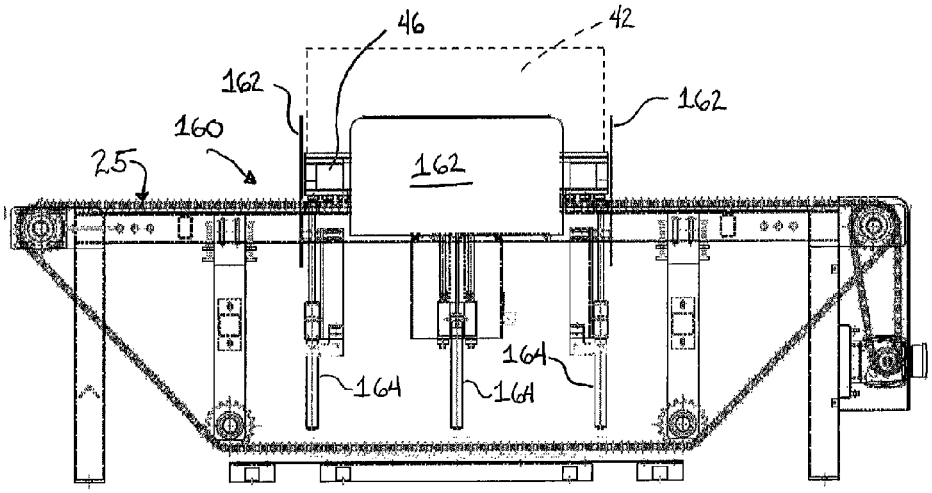
FIG. 19A is a side elevational view of a stretch hooder conveyor system shown in relation to an illustrative embodiment of a bottom sheet folding mechanism.
Figure 19B:
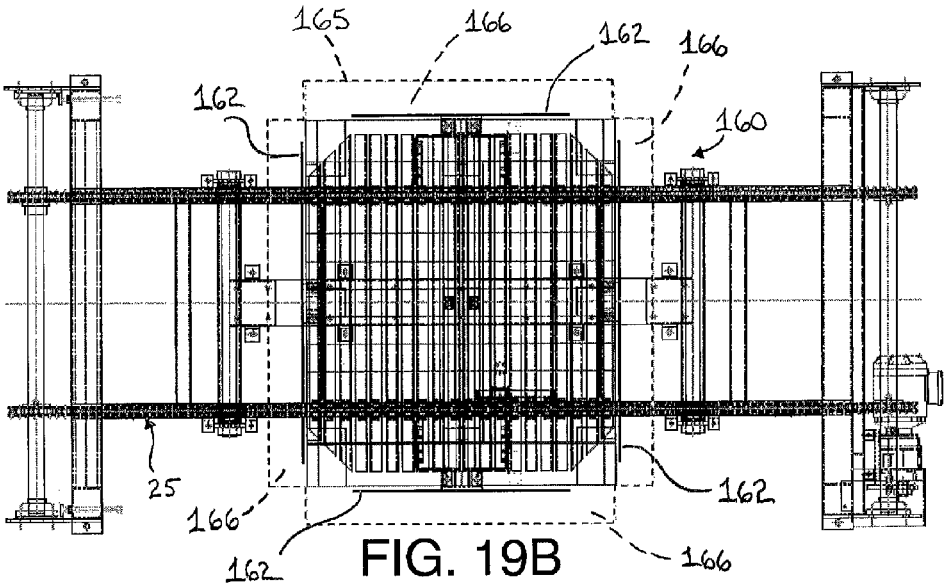
FIG. 19B is a top plan view of the conveyor system and bottom sheet folding mechanism of FIG. 19A with a bottom sheet schematically illustrated.

An example of a folding subsystem or mechanism 160 for upwardly folding a bottom sheet 165 is illustrated in FIGS. 19A and 19B. As there shown, folding mechanism 160 is positioned in cooperation with conveyor system 25, which may be located within a floor pit and as noted above is positioned within hooding location 34 for moving the load 42 to hooding location 34 after accepting the load from input section 30 of conveyor subsystem 24, and delivers load 42 to output section 32 after the stretch hooding operation has been completed. Folding mechanism 160 includes multiple upwardly extendable members disclosed as plates 162, each of which are mounted to drivers or actuators disclosed as cylinders 164 that are operated by controller 60 for extending and retracting plates 162. FIG. 19A illustrates plates 162 in the extended orientation with the plates 162 disposed about the sides of a pallet 46 upon which a load 42 would be placed. In the illustrated embodiment a separate plate 162 and cylinder 164 are oriented for each of the four sides of a load 42. Alternatively a single lift mechanism may be used to simultaneously raise multiple plates. When not in use, or prior to or after enveloping of a load, cylinders 164 downwardly retract plates 162 such that plates 162 do not interfere with movement of pallet 46 on conveyor system 25. In operation, upon a load 42 being received within hooding location 34 having a bottom sheet 165 disposed between the load 42 and pallet 46, controller 60 causes cylinders 164 to extend plates 162 such that the flaps 166 or portion of bottom sheet 165 (FIG. 19B) extending beyond the perimeter of load 42 are folded upwardly, such as after corner posts 40 have been applied to the corners 48 of load 42. Plates 162 may there after remain extended during the enveloping of load 42 by enveloping machine 22, with plates 162 being retracted from between the enveloping material and load 42 upon completion.

Figure 19D:
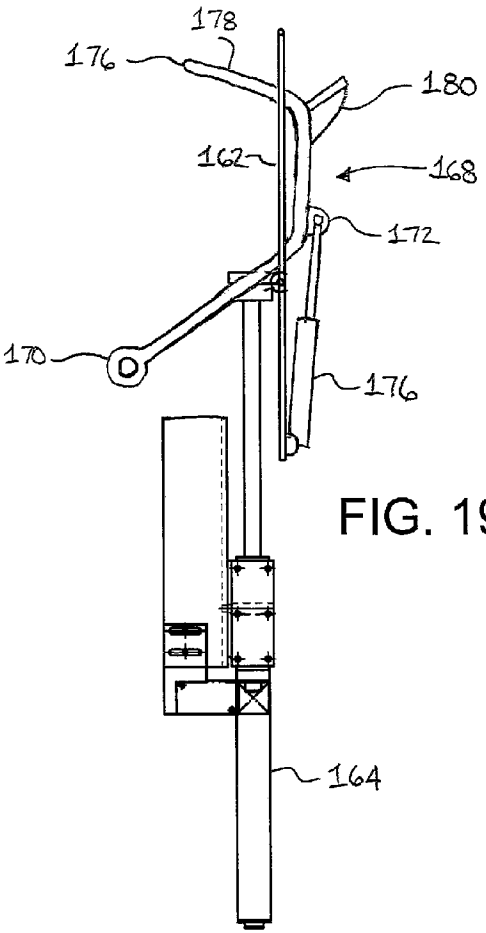
FIGS. 19C and 19D are partial views of an alternative bottom sheet folding mechanism employing a swing arm, with the swing arm shown in two alternative positions.
Figure 19C:
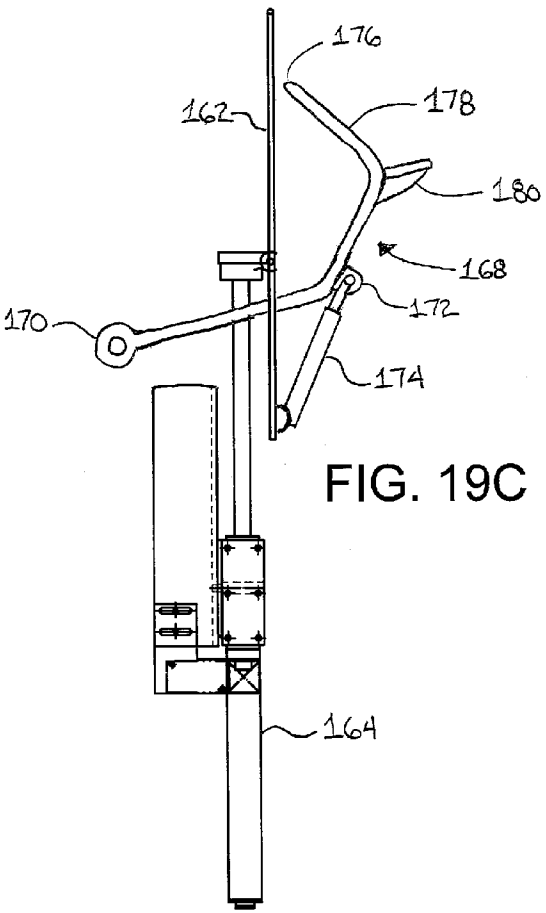
Figure 20:
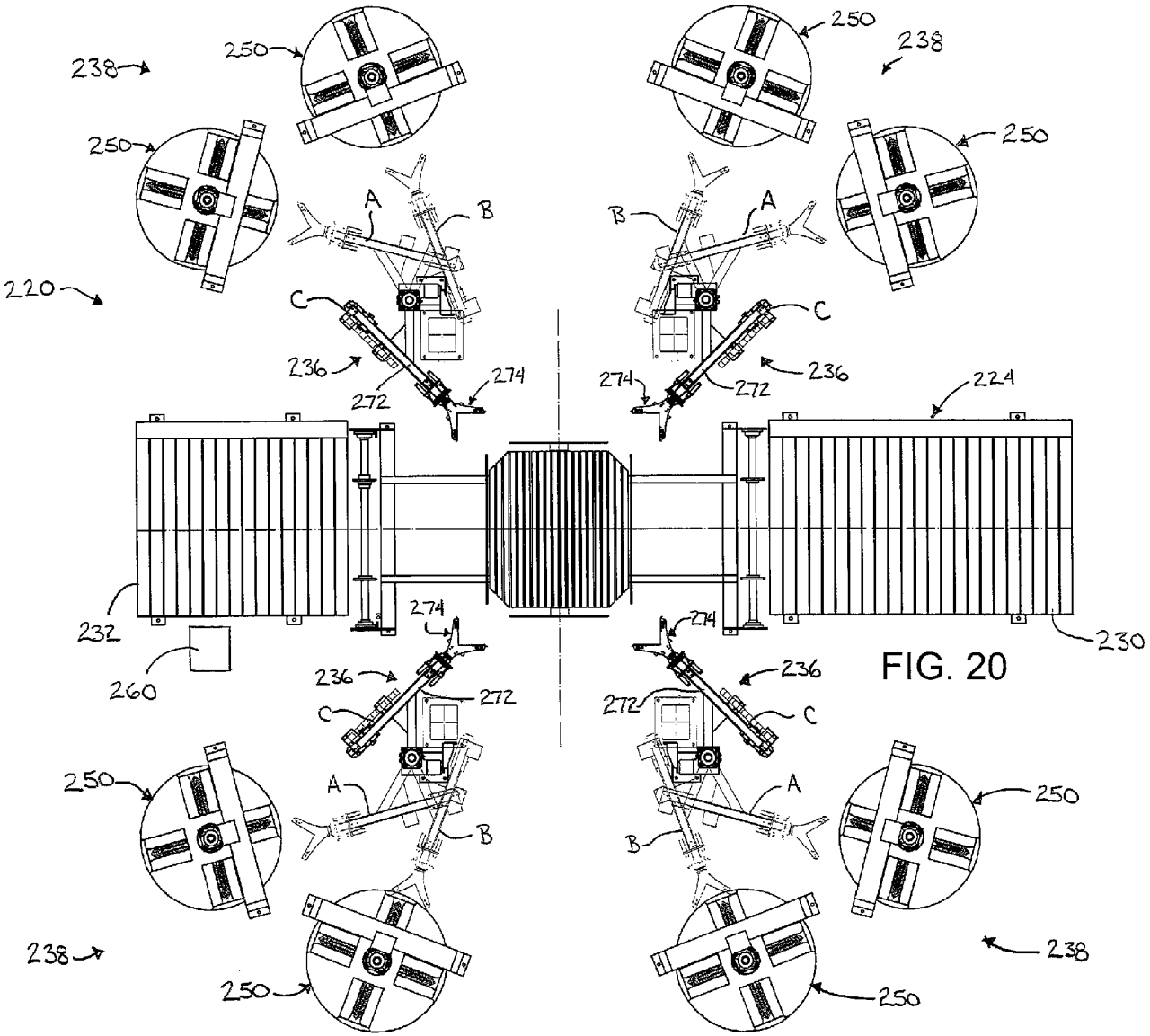
FIG. 20 is a partial plan view of another illustrative embodiment of a corner post application system and four corner post applicators.
Figure 21:
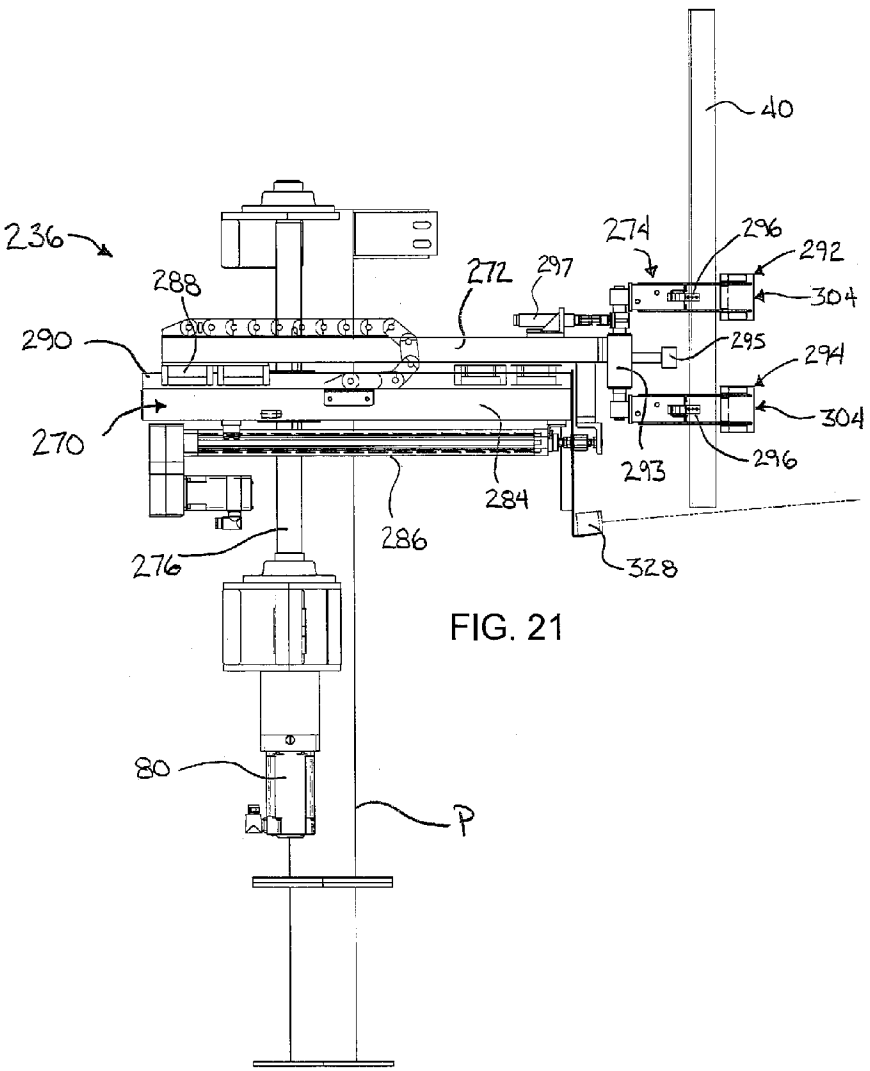
FIG. 21 is a side elevational view of an alternative corner post applicator embodiment in accordance with the system of FIG. 20.
Figure 22:
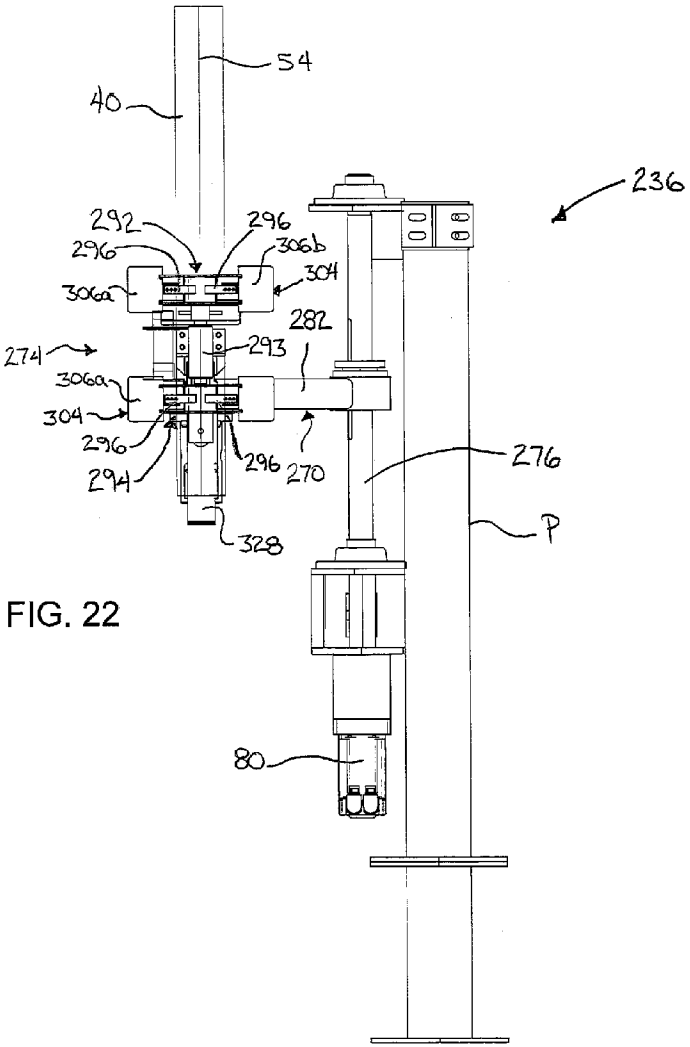
FIG. 22 is a front elevational view of the corner post applicator of FIG. 21.
Figure 23:
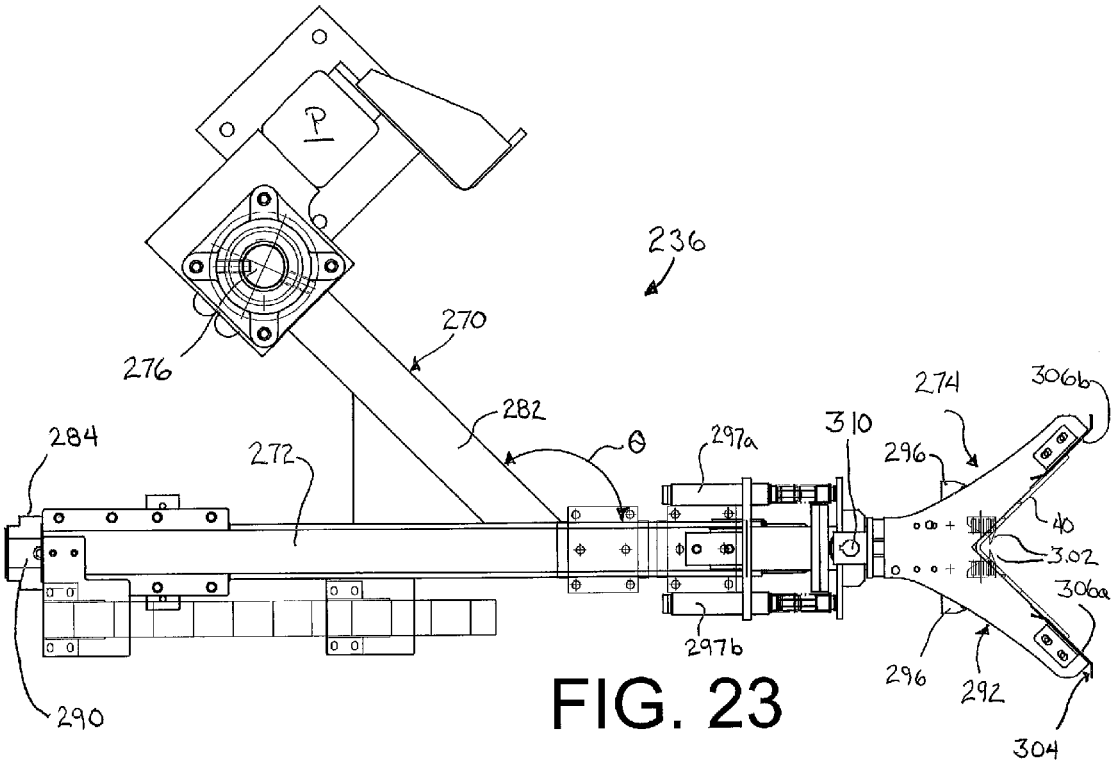
FIG. 23 is a top plan view of the corner post applicator of FIG. 21.

FIGS. 19C and 19D illustrate a further alternative to folding mechanism 160 in which a pivoting swing fold arm 168 is mounted for movement with plate 162, where swing fold arm 168 is constructed for providing additional folding to a bottom sheet that is not flush with the edges of a pallet—that is the load is located inboard of the perimeter of the pallet. Swing fold arm 168 is generally curved or hook shaped and incorporates a first pivot point 170 and a second pivot point 172. When plate 162 is extended, as shown, a second actuator 174 affixed to plate 162 and to second pivot point 172, which is formed as a tab, extends (FIG. 19D) to cause swing fold arm 168 to rotate about first pivot point 170 and extends the end 176 of member 178 of swing fold arm 168 past plate 162, such as through an aperture or slot in plate 162, whereby end 176 contacts and pushes a flap of bottom sheet such that the flap would contact the inboard located load thereon. Swing fold arm 168 further includes a catcher 180 formed as a projection, where catcher 180 is adapted to prevent the enveloping material from being applied vertically below catcher 180. Swing fold arm 168 is affixed to a sliding bracket (not shown) to enable up and down movement of swing fold arm 168.

Figure 12:
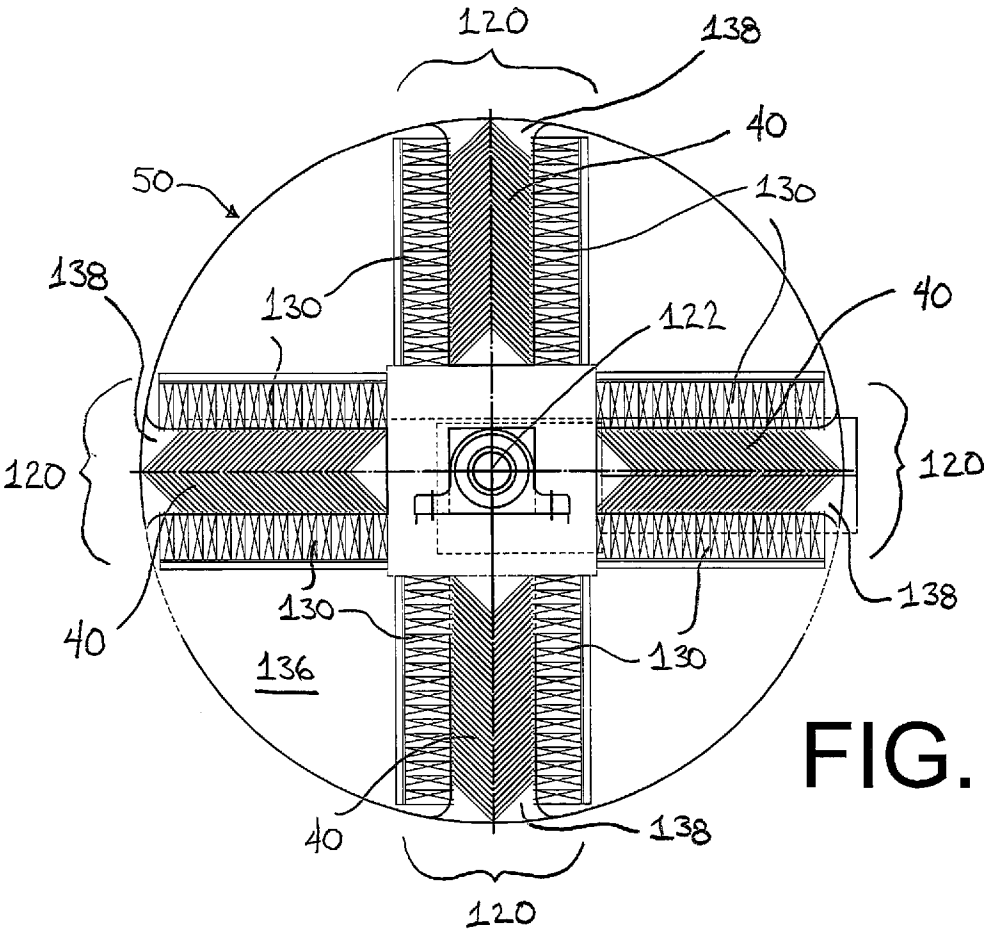
FIG. 12 is a plan view of a carousel corner post holder according to one embodiment.
Figure 13:
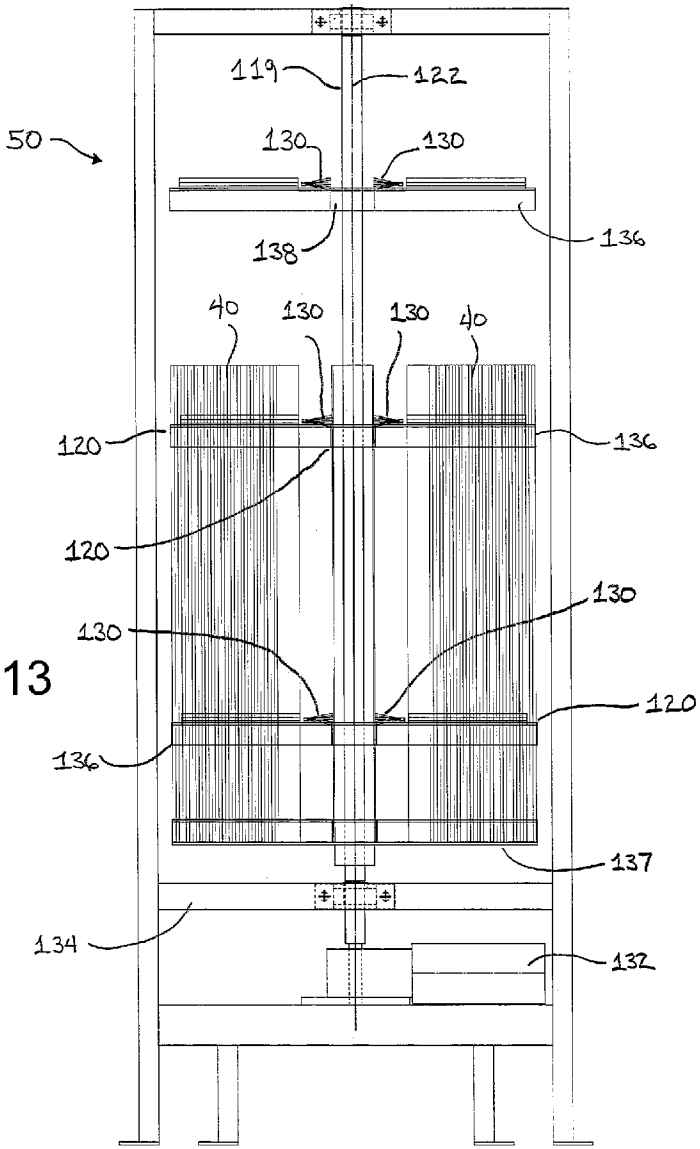
FIG. 13 is a side elevational view of the carousel corner post holder of FIG. 12.
Figure 14:
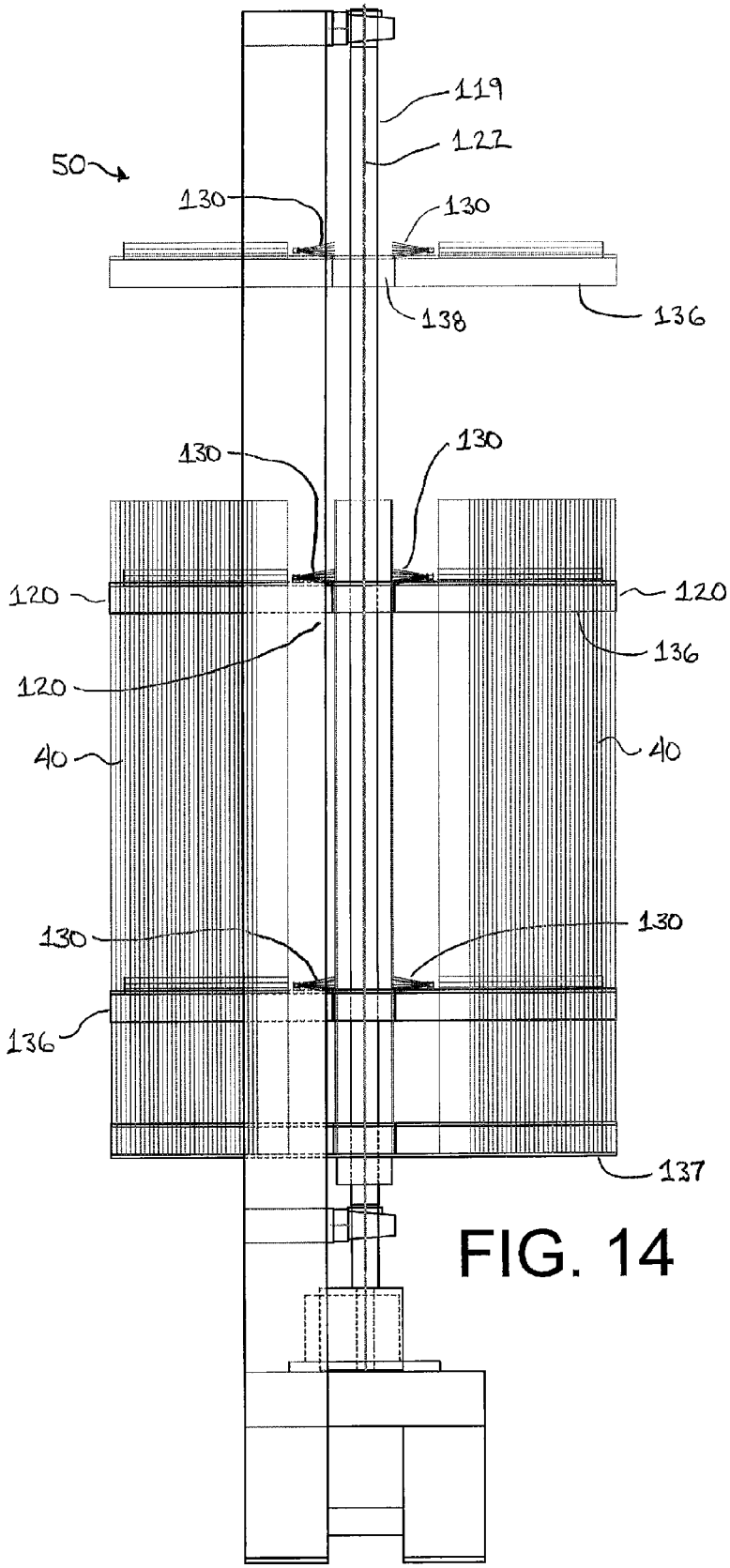
FIG. 14 is a front elevational view of the carousel corner post holder of FIG. 12.

One example of the construction of the carousel holders 50 is depicted in more detail in FIGS. 12-14. As shown therein, each holding unit 120 may include a set of frictional retainers disclosed as brushes 130 positioned on each side of the vertical stack of corner posts. In the illustrated embodiment, carousel holders 50 include multiple stabilization decks 136 that rotate with corner post table 137, with each deck including or defining multiple slots 138. Brushes 130 are mounted on either side of slots 138 to define holding units 120. The set of brushes 130 frictionally prevents the corner posts from tipping or falling out of the holding unit 120, while still allowing a corner post 40 to be deliberately removed by corner post gripper 74. A spring-loaded mechanism, or other similar device, may be included in the carousel holders 50 to advance the corner posts 40 radially outward by an amount approximately equal to the thickness of one corner post 40 after a corner post 40 is removed from carousel holder 50. Such a mechanism need not be powered by an independent power source or actuator, thereby reducing the costs that would otherwise be associated with a powered actuator. Alternatively, no mechanism might be provided for advancing the corner posts out of the carousel. Instead, applicator arm 72 might reach further and further into holding unit 120 each time it grabs a corner post 40. In such a case, clearance for extension guides 104 might be provided by vertically displacing extension guides from grippers 92 and 94, or guidewalls 106 might be constructed to be selectively flexible, or other designs might be adopted.

As illustrated more clearly in FIG. 13, each carousel holder 50 may include a motor 132 positioned underneath a platform 134 above which the corner posts 40 are held. Motor 132 is adapted to rotate carousel 50 about its vertical axis 122 under the control of controller 60. One or more sensors may be included on carousel 50 for detecting the presence of corner posts 40 within holding units 120. Sensors, for example, may be mounted to platform 134 and detect the presence of corner posts 40 through apertures in the rotating support member or table 137 associated with each holding unit 120. Because each carousel holder 50 includes multiple holding units 120, it can be manually re-stocked by authorized personnel during the stretch hooding process without having to stop the stretch hooding, applicator 36, or any of the other components of system 20. Such manual restocking may take place after three of the four holding units on a carousel holder 50 are depleted. In such a case, an authorized person may fill the three depleted holding units 120 while system 20 is utilizing the fourth holding unit, thereby avoiding any interruption to the system. Alternatively, such re-stocking may occur at different times if different sized posts are used, or if other considerations are desired.

Controller 60 may be any suitable electronic device capable of carrying out the control algorithms described herein. As one example, controller 60 may be a Programmable Logic Controller (PLC) that is in communication with all of the actuators and sensors described herein, as well as any sensors or actuators associated directly with stretch hooding machine 22. While not illustrated, such communication may take place by suitable wiring and/or cabling, as would be known to one of ordinary skill in the art. Alternatively, one or more communication channels between controller 60 and any of the sensors or actuators may take place wirelessly.

As an alternative to a PLC, controller 60 may be a personal computer, a server, or custom electronic device made up of suitable components, such as one or more microprocessors, integrated circuits, discrete logic, field programmable gate arrays, application specific integrated circuits (ASICs), or the like, as would be known to one of ordinary skill in the art.

With reference to FIGS. 20-25, an alternative corner post application system 220 in according to another embodiment of the present invention is illustrated, with the similar components or features of system 220 being identified with similar reference numbers relative to the corner post application system 20, but with "200" added to the reference numbers of corner post application system 220. It should be appreciated that due to the similarities, not all components or features of corner post application system 220 are discussed in detail below.

Corner post application system 220 includes four corner post applicators 236 positioned to apply corner posts 40 obtained from carousel holders 250 to a load being transported by conveyor subsystem 240. As shown, each corner post applicator 236 is illustrated in positions "A", "B", and "C", with positions "A" and "B" illustrating the obtaining of corner posts from separate ones of the two carousel holders 250 associated with each corner post applicator 236, and position "C" illustrating the orientation in which a corner post 40 would be advanced for placement against a load.

With reference to FIGS. 21-24, corner post applicator 236 are mounted to poles P and include a swing arm 270 having a first section 282 and a second section 284 joined at an angle theta, an extendable and retractable applicator arm 272, and an actuator 286, such as a pneumatic actuator or servo controlled actuator, for extending and retracting applicator arm 272. Actuator 280 enables rotation of swing arm 270 about pivot shaft 276. Affixed to applicator arm is corner post gripper 274, which includes both an upper gripper 292 and a lower gripper 294 that are vertically spaced and affixed together, such as by a vertical rotation pivot shaft 293. Sensor 328 for use in detection of a corner of a load is mounted to second section 284 of swing arm 270 and is vertically aligned with the generally V-shaped openings of corner post gripper 274 such that sensor 328 is aligned with the vertical axis of a corner post 40 retained or held by corner post gripper 274. As also shown, corner post gripper 274 includes a sensor 295, such as a photo eye, for detecting the presence of a corner post 40 held by corner post gripper 274. As discussed above, sensor 328 may measure the distance to load 42 that would initially decrease to a minimum when corner post gripper 274 is aligned with a corner of a load and then increase as sensor 328 is rotated past. With controller 60 monitoring this distance, swing arm 270 may then be counter rotated back to align corner post gripper 274 and the associated corner post 40 with the corner.

Figure 24:
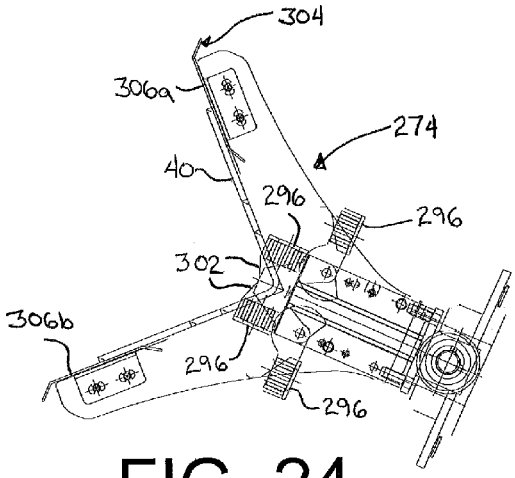
FIG. 24 is an enlarged partial top plan view of the corner post gripper portion of the corner post applicator of FIG. 21.

Corner post applicator 236 further includes a pair of gas dampening cylinders 297*a*, 297*b* mounted to applicator arm 272 and operatively connected with corner post gripper 274, with cylinders 297*a*, 297*b* enabling corner post gripper 274 to pivot about pivot axis 310, such as when one of the guidewalls 306, which are formed as plates, of corner post gripper 274 come into contact with a load during application of corner post 40, but also bias corner post gripper 274 into an aligned default position. Cylinders 297*a*, 297*b* thus aid in maintaining alignment of corner post gripper 274 while providing or enabling resistive or dampened pivoting movement of corner post gripper 274. FIG. 24 discloses the pair of pivoting fingers 296 of corner post gripper 274 in both the open position (axially aligned) and the closed position (parallel axes). Each finger 296 includes a sharp protrusion or point 302 for grasping a corner post 40 there between.

Figure 25:
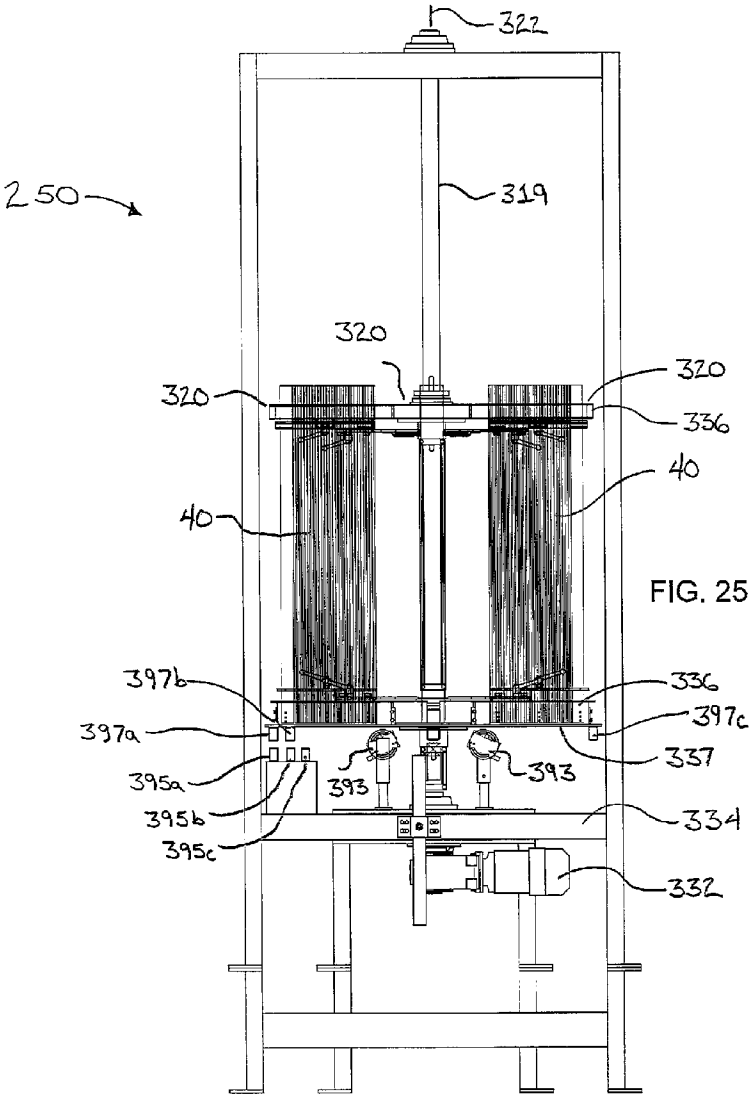
FIG. 25 is a side elevational view of an alternative carousel corner post holder embodiment in accordance with the system of FIG. 20.

With reference to FIG. 25, carousel holder 250 is shown as including a platform 334, a motor 332 for rotating table 337, and stabilization decks 336 for defining holding units 320 therein. As also shown, sensors 393, such as photo eyes, are used to determine the presence of corner posts 40 within carousel holder 250 through apertures in table 337, with the signal from sensors 393 being transmitted to controller 60. Carousel holder 250 further includes sensors for confirming/controlling the positioning of particular holding units 320 of carousel holder 250 in relation to corner post applicator 236, such as proximity sensors 395*a*, 395*b*, 395*c*. In the illustrated embodiment, protrusions 397*a*, 397*b*, 397*c* are mounted to the underside of table 337 for rotation therewith. By arranging protrusions 397 controller 60 is able to confirm/control the positioning of holding units 320. For example, separate ones or combinations of protrusions 397*a*, 397*b* and/or 397*c* may be aligned with separate ones or combinations of sensors 395*a*, 395*b* and/or 395*c* for signifying which holding unit 320 is aligned with corner post applicator 236 to enable the desired corner post 40 to be grasped, such as based on height or presence of corner posts 40 as determined by sensors 393.

While the foregoing description describes several embodiments of the present invention, it will be understood by those skilled in the art that variations and modifications to these embodiments may be made without departing from the spirit and scope of the invention, as defined in the claims below.

What is claimed is:

1. A corner post application system comprising:

a conveyor subsystem adapted to linearly move a load containing a plurality of units;

an enveloping machine adapted to envelope said plurality of units with a material such that said plurality of units are bound together, said enveloping machine aligned with said conveyor subsystem such that said conveyor subsystem delivers the load to said enveloping machine;

a swing arm;

an applicator arm coupled to said swing arm and adapted to move linearly;

a corner post gripper coupled to said applicator arm; and a controller adapted to rotate said swing arm about a vertical pivot axis until said controller determines a corner post held by said corner post gripper is aligned with adjacent sides that define a corner of the load, said controller thereafter adapted to stop rotation of said swing arm about said vertical pivot axis and to move said applicator arm linearly toward the corner of the load until a first side of the corner post held by said corner post gripper contacts a first one of said adjacent sides of the load and a second side of the corner post contacts a second one of said adjacent sides of the load, and further including a sensor adapted to detect a corner of the load, and wherein said sensor is mounted for rotational movement with said swing arm and detects a corner of the load by repetitively measuring a distance between said sensor and the load as said swing arm rotates and wherein said controller determines when a minimum value for said distance is measured.

2. The system of claim 1 wherein said enveloping machine is a stretch hooding machine.

3. The system of claim 1 wherein said distance said sensor measures between said sensor and the load initially decreases to a minimum while said controller rotates said swing arm and then increases once said sensor is rotated past the corner of the load.

4. The system of claim 3 wherein said sensor is vertically aligned with said corner post gripper such that said sensor is aligned with the vertical axis of a corner post when the corner post is retained within said corner post gripper, and wherein said controller initially rotates said corner post gripper past the corner of the load and then rotates said corner post gripper in the opposite direction until said corner post gripper is aligned with the corner of the load.

5. A corner post application system comprising:

a conveyor subsystem adapted to linearly move a load containing a plurality of units;

an enveloping machine adapted to envelope said plurality of units with a material such that said plurality of units are bound together, said enveloping machine aligned with said conveyor subsystem such that said conveyor subsystem delivers the load to said enveloping machine;

a swing arm;

an applicator arm coupled to said swing arm and adapted to move linearly;

a corner post gripper coupled to said applicator arm; and a controller adapted to rotate said swing arm about a vertical pivot axis until said controller determines a corner post held by said corner post gripper is aligned with adjacent sides that define a corner of the load, said controller thereafter adapted to stop rotation of said swing arm about said vertical pivot axis and to move said applicator arm linearly toward the corner of the load until a first side of the corner post held by said corner post gripper contacts a first one of said adjacent sides of the load and a second side of the corner post contacts a second one of said adjacent sides of the load, and further including a corner post holder adapted to supply corner posts to said corner post gripper, said corner post holder including a carousel adapted to rotate about a vertical axis, said carousel including a plurality of separate holding units with each said holding unit adapted to retain a plurality of corner posts.

6. The system of claim 5 wherein each said holding unit of said corner post holder holds said corner posts in a vertical orientation, and wherein each said holding unit includes a frictional retainer to maintain said corner posts within said holding unit.

7. The system of claim 5 further including a plurality of said corner post holders associated with said swing arm, said controller adapted to control said swing arm so as to enable said corner post gripper to pick a corner post from one of said corner post holders.

8. A corner post application system comprising:

a conveyor subsystem adapted to linearly move a load containing a plurality of units;

an enveloping machine adapted to envelope said plurality of units with a material such that said plurality of units are bound together, said enveloping machine aligned with said conveyor subsystem such that said conveyor subsystem delivers the load to said enveloping machine;

a swing arm;

an applicator arm coupled to said swing arm and adapted to move linearly;

a corner post gripper coupled to said applicator arm; and a controller adapted to rotate said swing arm about a vertical pivot axis until said controller determines a corner post held by said corner post gripper is aligned with adjacent sides that define a corner of the load, said controller thereafter adapted to stop rotation of said swing arm about said vertical pivot axis and to move said applicator arm linearly toward the corner of the load until a first side of the corner post held by said corner post gripper contacts a first one of said adjacent sides of the load and a second side of the corner post contacts a second one of said adjacent sides of the load, and further including;

a plurality of additional swing arms, a plurality of additional applicator arms, and a plurality of additional corner post grippers;

wherein separate ones of each said additional swing arm, said additional applicator arm, and said additional corner post gripper are adapted to place a corner post at another corner of the load in the same manner as said swing arm, said applicator arm, and said corner post gripper.

9. A corner post application system comprising:

a conveyor subsystem adapted to linearly move a load containing a plurality of units;

an enveloping machine adapted to envelope said plurality of units with a material such that said plurality of units are bound together, said enveloping machine aligned with said conveyor subsystem such that said conveyor subsystem delivers the load to said enveloping machine;

a swing arm;

an applicator arm coupled to said swing arm and adapted to move linearly;

a corner post gripper coupled to said applicator arm; and a controller adapted to rotate said swing arm about a vertical pivot axis until said controller determines a corner post held by said corner post gripper is aligned with adjacent sides that define a corner of the load, said controller thereafter adapted to stop rotation of said swing arm about said vertical pivot axis and to move said applicator arm linearly toward the corner of the load until a first side of the corner post held by said corner post gripper contacts a first one of said adjacent sides of the load and a second side of the corner post contacts a second one of said adjacent sides of the load, wherein said corner post gripper includes at least one extension guide coupled thereto, said extension guide extending horizontally farther than a corner post held by said corner post gripper such that, during movement of the held corner post toward the load, said extension guide will contact the load prior to the held corner post if there is misalignment between the first and second sides of the held corner post with the adjacent sides of the load.

10. A corner post application system comprising:

a conveyor subsystem adapted to linearly move a load containing a plurality of units;

an enveloping machine adapted to envelope said plurality of units with a material such that said plurality of units are bound together, said enveloping machine aligned with said conveyor subsystem such that said conveyor subsystem delivers the load to said enveloping machine;

a swing arm;

an applicator arm coupled to said swing arm and adapted to move linearly;

a corner post gripper coupled to said applicator arm; and a controller adapted to rotate said swing arm about a vertical pivot axis until said controller determines a corner post held by said corner post gripper is aligned with adjacent sides that define a corner of the load, said controller thereafter adapted to stop rotation of said swing arm about said vertical pivot axis and to move said applicator arm linearly toward the corner of the load until a first side of the corner post held by said corner post gripper contacts a first one of said adjacent sides of the load and a second side of the corner post contacts a second one of said adjacent sides of the load, wherein said corner post gripper is generally V-shaped and includes a pair of fingers, said fingers being mounted to said corner post gripper for aligned inward and outward pivoting movement relative to one another with each said finger including a projection, said corner post gripper being adapted to selectively hold a corner post by inward pivoting of said fingers whereby said projection of one said finger engages the first side of the corner post and said projection of the other said finger engages the second side of the corner post.

11. The system of claim 10 wherein said corner post gripper includes a top gripper and a bottom gripper, said top gripper being vertically aligned with said bottom gripper, and wherein both said top gripper and said bottom gripper are generally V-shaped and include a pair of said fingers.

12. A corner post application system comprising:

a conveyor subsystem adapted to linearly move a load containing a plurality of units;

an enveloping machine adapted to envelope said plurality of units with a material such that said plurality of units are bound together, said enveloping machine aligned with said conveyor subsystem such that said conveyor subsystem delivers the load to said enveloping machine;

a swing arm;

an applicator arm coupled to said swing arm and adapted to move linearly;

a corner post gripper coupled to said applicator arm; and a controller adapted to rotate said swing arm about a vertical pivot axis until said controller determines a corner post held by said corner post gripper is aligned with adjacent sides that define a corner of the load, said controller thereafter adapted to stop rotation of said swing arm about said vertical pivot axis and to move said applicator arm linearly toward the corner of the load until a first side of the corner post held by said corner post gripper contacts a first one of said adjacent sides of the load and a second side of the corner post contacts a second one of said adjacent sides of the load, and further including a lifting subsystem adapted to lift a slip sheet positioned on top of said load while a corner post is moved into contact with the load, and including a sheet folding subsystem adapted to upwardly fold a bottom sheet positioned beneath a load.

13. A corner post application system for applying corner posts to a load having at least two sides that define a load corner, said corner post application system comprising:

a corner post supply;

a corner post applicator adapted to move a corner post from said corner post supply to the load corner; and a controller adapted to rotate said corner post applicator about a vertical pivot axis until said controller determines a retained corner post is aligned with the load corner, said controller thereafter adapted to stop rotation of said corner post applicator about said vertical pivot axis and to move said corner post completely linearly toward the load corner until contact is made between the corner post and the load, and further including a sensor adapted to detect the load corner and wherein said sensor is mounted for rotational movement with said corner post applicator and detects the load corner by repetitively measuring a distance between said sensor and the load as said corner post applicator rotates and wherein said controller determines when a minimum value for said distance is measured.

14. The system of claim 13 wherein said distance said sensor measures between said sensor and the load initially decreases to a minimum while said controller rotates said corner post applicator and then increases once said sensor is rotated past the load corner.

15. A corner post application system for applying corner posts to a load having at least two sides that define a load corner, said corner post application system comprising:

a corner post supply;

a corner post applicator adapted to move a corner post from said corner post supply to the load corner; and a controller adapted to rotate said corner post applicator about a vertical pivot axis until said controller determines a retained corner post is aligned with the load corner, said controller thereafter adapted to stop rotation of said corner post applicator about said vertical pivot axis and to move said corner post completely linearly toward the load corner until contact is made between the corner post and the load, wherein said corner post supply includes a carousel adapted to rotate about a vertical axis wherein said carousel includes a plurality of separate holding units, and wherein each said holding unit retains a plurality of said corner posts in a vertical orientation by a least one frictional retainer.

16. A corner post application system for applying corner posts to a load having at least two sides that define a load corner, said corner post application system comprising:

a corner post supply;

a corner post applicator adapted to move a corner post from said corner post supply to the load corner; and a controller adapted to rotate said corner post applicator about a vertical pivot axis until said controller determines a retained corner post is aligned with the load corner, said controller thereafter adapted to stop rotation of said corner post applicator about said vertical pivot axis and to move said corner post completely linearly toward the load corner until contact is made between the corner post and the load, wherein said corner post supply includes a plurality of carousel corner post holders associated with said corner post applicator, said controller adapted to control said corner post applicator so as to enable said corner post applicator to pick a corner post from one of said carousel corner post holders.

17. A corner post application system for applying corner posts to a load having at least two sides that define a load corner, said corner post application system comprising:

a corner post supply;

a corner post applicator adapted to move a corner post from said corner post supply to the load corner; and a controller adapted to rotate said corner post applicator about a vertical pivot axis until said controller determines a retained corner post is aligned with the load corner, said controller thereafter adapted to stop rotation of said corner post applicator about said vertical pivot axis and to move said corner post completely linearly toward the load corner until contact is made between the corner post and the load, wherein said corner post applicator includes a corner post gripper having at least one extension guide coupled thereto, said extension guide extending horizontally farther than a corner post held by said corner post gripper such that, during movement of the held corner post toward the load, said extension guide will contact the load prior to the held corner post if there is misalignment between the held corner post and the adjacent sides of the load.

* * * * *